US010184293B1

(12) United States Patent
McCalib, Jr. et al.

(10) Patent No.: US 10,184,293 B1
(45) Date of Patent: Jan. 22, 2019

(54) SLIDING LADDER UNITS

(71) Applicant: Amazon Technologies, Inc., Seattle, WA (US)

(72) Inventors: David Bruce McCalib, Jr., Seattle, WA (US); Jeffrey L. Weeks, South Easton, MA (US); Aimee Constantine, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 99 days.

(21) Appl. No.: 14/665,456

(22) Filed: Mar. 23, 2015

(51) Int. Cl.
*E06C 9/12* (2006.01)

(52) U.S. Cl.
CPC ..... *E06C 9/12* (2013.01)

(58) Field of Classification Search
CPC ..... E06C 9/00; E06C 9/06; E06C 9/08; E06C 9/085; E06C 9/12; A47C 12/02
See application file for complete search history.

(56) References Cited

U.S. PATENT DOCUMENTS 442,531 A * 12/1890 Murray ..... E06C 1/397 182/15
443,299 A * 12/1890 Smith ..... E06C 9/12 182/38
499,028 A * 6/1893 Murray ..... E06C 9/12 182/38
508,099 A * 11/1893 Fisher ..... E06C 9/12 182/39
594,582 A * 11/1897 Wildprett ..... E06C 1/382 182/159
706,162 A * 8/1902 Coburn ..... E06C 9/12 182/38
743,692 A * 11/1903 Daemicke ..... E06C 9/12 182/38
1,439,388 A * 12/1922 Willett ..... E06C 1/393 182/113
1,452,076 A * 4/1923 Howard ..... E06C 1/397 182/115
1,658,192 A * 2/1928 Hampton ..... E06C 9/12 188/42
2,670,968 A * 3/1954 Duffy ..... B60R 3/02 182/86
2,809,849 A * 10/1957 Benne ..... B60R 3/02 182/88
2,827,215 A * 3/1958 Burg ..... B62B 5/00 182/15

(Continued)

*Primary Examiner* — Katherine W Mitchell
*Assistant Examiner* — Shiref M Mekhaeil
(74) *Attorney, Agent, or Firm* — Athorus, PLLC

(57) ABSTRACT

A ladder unit is slidably joined to an edge of or beneath a working surface by a mounting frame having a roller assembly or other slidable means. The ladder unit includes a stair assembly that is rotatably mounted to the mounting frame by a hinge, and configured to rotate between an open position, in which a support provided on the stair assembly does not contact the working surface, and a closed position, in which the support contacts the working surface. In this regard, the ladder unit may be slidably moved from location to location along the working surface when the stair assembly is in the open position with substantially low friction, and may be stabilized in a location for use when the stair assembly is in the closed position.

18 Claims, 17 Drawing Sheets

(56) References Cited

U.S. PATENT DOCUMENTS

| | | | | | |
|---|---|---|---|---|---|
| 3,020,972 | A * | 2/1962 | Hockett | B62B 3/00 | 182/120 |
| 3,517,942 | A * | 6/1970 | Cuffe | B60R 3/02 | 280/166 |
| 3,556,248 | A * | 1/1971 | Brown | E06C 5/02 | 182/15 |
| 3,862,670 | A * | 1/1975 | Hovey | B63B 27/146 | 182/195 |
| 3,891,261 | A * | 6/1975 | Finneman | B60R 3/02 | 105/447 |
| 4,174,021 | A * | 11/1979 | Barlock | B62B 5/00 | 182/127 |
| 5,427,049 | A * | 6/1995 | Mardikian | B63B 35/731 | 114/274 |
| 5,458,080 | A * | 10/1995 | Jaramillo, Sr. | B63B 27/14 | 114/362 |
| 7,637,519 | B2 * | 12/2009 | Leitner | B60R 3/02 | 280/163 |
| 7,740,261 | B2 * | 6/2010 | Leitner | B60R 3/02 | 280/163 |
| 9,346,405 | B2 * | 5/2016 | Leitner | B60R 3/02 | |
| 9,573,609 | B2 * | 2/2017 | Yu | E06C 7/02 | |
| 2003/0019976 | A1 * | 1/2003 | Cheung | B64D 11/0604 | 244/118.5 |
| 2013/0248285 | A1 * | 9/2013 | Kerr | E06C 9/12 | 182/36 |
| 2016/0053538 | A1 * | 2/2016 | Wallther | E04G 5/10 | 182/113 |
| 2016/0108671 | A1 * | 4/2016 | Cale | E06C 1/39 | 182/106 |

* cited by examiner

SLIDING LADDER UNITS

BACKGROUND

In a modern materials handling facility, operational efficiency may be enhanced by increasing the storage density, e.g., the number, volume or mass of items stored at the materials handling facility, on a per-square foot basis. Storage density may be increased in an effective manner relative to the cost of new construction by expanding the capacity of a materials handling facility in a vertical direction, such as by adding one or more fixed or moving shelving systems, which enable the storage of different types of items at different elevations within the materials handling facility. Such shelving systems may include one or more racks, mezzanines, bars, platforms, bins, cabinets, drawers or other like storage units where items may be stored on a temporary basis or for extended durations.

In a materials handling facility, one or more workers typically deposit one or more items into a storage unit, and retrieve such items therefrom at a later time. Therefore, where a materials handling facility includes one or more shelving systems or other vertically mounted or oriented storage units, a worker must change his or her elevation in order to deposit one or more of the items therein, or retrieve one or more of the items therefrom. In the interests of economy, however, many materials handling facilities include shelving systems that feature storage units that are out-of-reach to most humans. For example, in many materials handling facilities such as file storage depots or hardware stores, shelves of nine, thirteen or even fifteen feet in height are common.

In order for a worker to access storage units that are included in one or more shelving systems, a ladder or other platform-like device is typically provided. A ladder may include a variety of steps that may be ascended or descended by a worker in order to place an item within one or more storage units provided on a shelving system, or to access an item that is provided within one or more of the storage units, as well as one or more auxiliary shelves, support rails, steps, hinges, braces or locks. When using a ladder, a worker must typically move the ladder to a convenient location with respect to the shelving system or storage unit in which he or she is interested, open or extend the ladder, before ascending and descending the ladder to access the shelving system or storage unit, e.g., to deposit an item into or retrieve an item from a storage unit, or to otherwise inspect the contents of the storage unit. Subsequently, in order to access another shelving system or storage unit, the worker (or another worker) must typically close or contract the ladder, relocate the ladder to another location associated with that shelving system or storage unit, and open or extend the ladder again, before ascending and descending the ladder to access that shelving system or storage unit.

Depending on the sizes of the shelving systems or storage units with which they are associated, ladders or other platform-like devices may typically occupy a substantial area or volume of a materials handling facility. The requirement to transport and operate a ladder prior to ascending or descending the ladder may tend to hinder their utility and value, and is one of many drawbacks to their widespread use in a materials handling facility.

BRIEF DESCRIPTION OF THE DRAWINGS

FIGS. 1A through 1C are views of components of one system including a sliding ladder unit in accordance with embodiments of the present disclosure, in which FIG. 1A shows a perspective view of the system, FIG. 1B shows a side view of the system with the sliding ladder unit in a raised position, and FIG. 1C shows a side view of the system with the sliding ladder unit in a lowered position.

FIGS. 2A through 2C are views of components of a sliding ladder unit in accordance with embodiments of the present disclosure, in which FIG. 2A shows a perspective view of the sliding ladder unit, FIG. 2B shows a front view of the sliding ladder unit, and FIG. 2C shows a side view of the sliding ladder unit.

FIGS. 3A through 3C are views of components of a sliding ladder unit in accordance with embodiments of the present disclosure, in which FIG. 3A shows a rear perspective view of the sliding ladder unit including a stair assembly and a mounting frame, FIG. 3B shows a side view of the sliding ladder unit in a raised position, and FIG. 3C shows a side view of the sliding ladder unit in a lowered position.

FIGS. 5A and 5B are views of components of one system including a sliding ladder unit in accordance with embodiments of the present disclosure, in which FIG. 5A shows the sliding ladder unit, a platform assembly, and a pair of autonomous mobile robots in a first arrangement, and FIG. 5B shows the sliding ladder unit, the platform assembly, and the pair of autonomous mobile robots in a second arrangement.

FIGS. 6A and 6B are views of components of one system including a sliding ladder unit in accordance with embodiments of the present disclosure, in which FIG. 6A shows a free body diagram of the sliding ladder unit in an unloaded condition, and FIG. 6B shows a free body diagram of the sliding ladder unit in a loaded condition.

FIGS. 7A and 7B are views of components of one system including a sliding ladder unit in accordance with embodiments of the present disclosure, in which FIG. 7A shows a free body diagram of the sliding ladder unit in an unloaded condition, and FIG. 7B shows a free body diagram of the sliding ladder unit in a loaded condition.

DETAILED DESCRIPTION

The systems and methods of the present disclosure are directed to sliding ladder units that may be provided in connection with one or more floors, platforms or other structures in a materials handling facility such as a fulfillment center, a warehouse or a department store. Sliding ladder units of the present disclosure may be mounted to platforms or other like structures by one or more slidable or rolling means, such as one or more rollers or translating assemblies which mate with one or more tracks or like features provided on the platforms, thereby enabling the sliding ladder units to translate between two or more locations with respect to the platforms. Additionally, the sliding ladder units may be provided with one or more biasing elements (e.g., springs) that cause one or more free supports or legs of the sliding ladder units to be elevated above the platform when the sliding ladder units are not loaded. When the sliding ladder units are loaded by the weight of a worker and any objects that he or she is carrying, the force generated by such biasing elements is overcome, and the supports or legs are placed firmly into contact with a platform or another like structure. Alternatively, some sliding ladder units of the present disclosure may include rollers or translating assemblies that mate with tracks or like features embedded within or suppressed beneath one or more floors or flooring units, such that the supports or legs are elevated above, or come into contact with, the floors or flooring units.

Figure 1A:
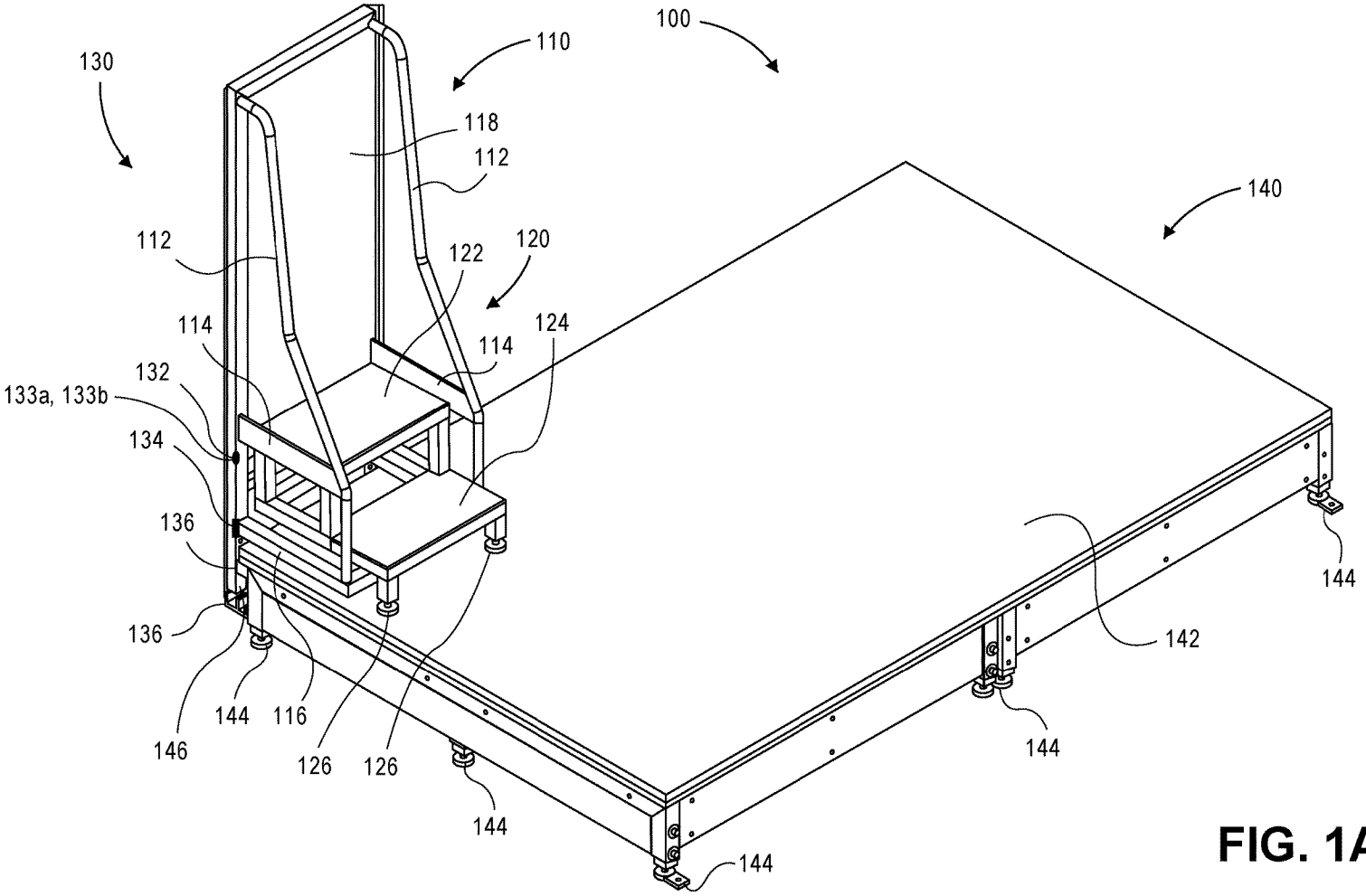
Figure 1B:
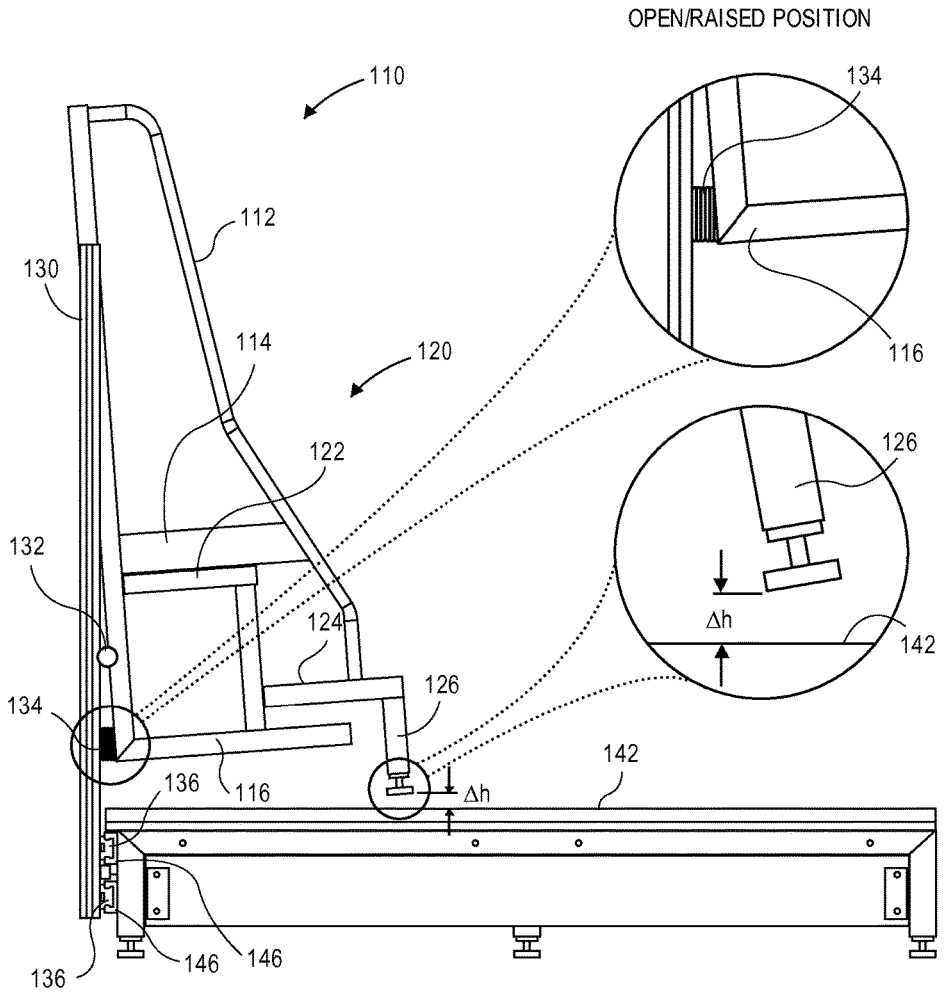
Figure 1C:
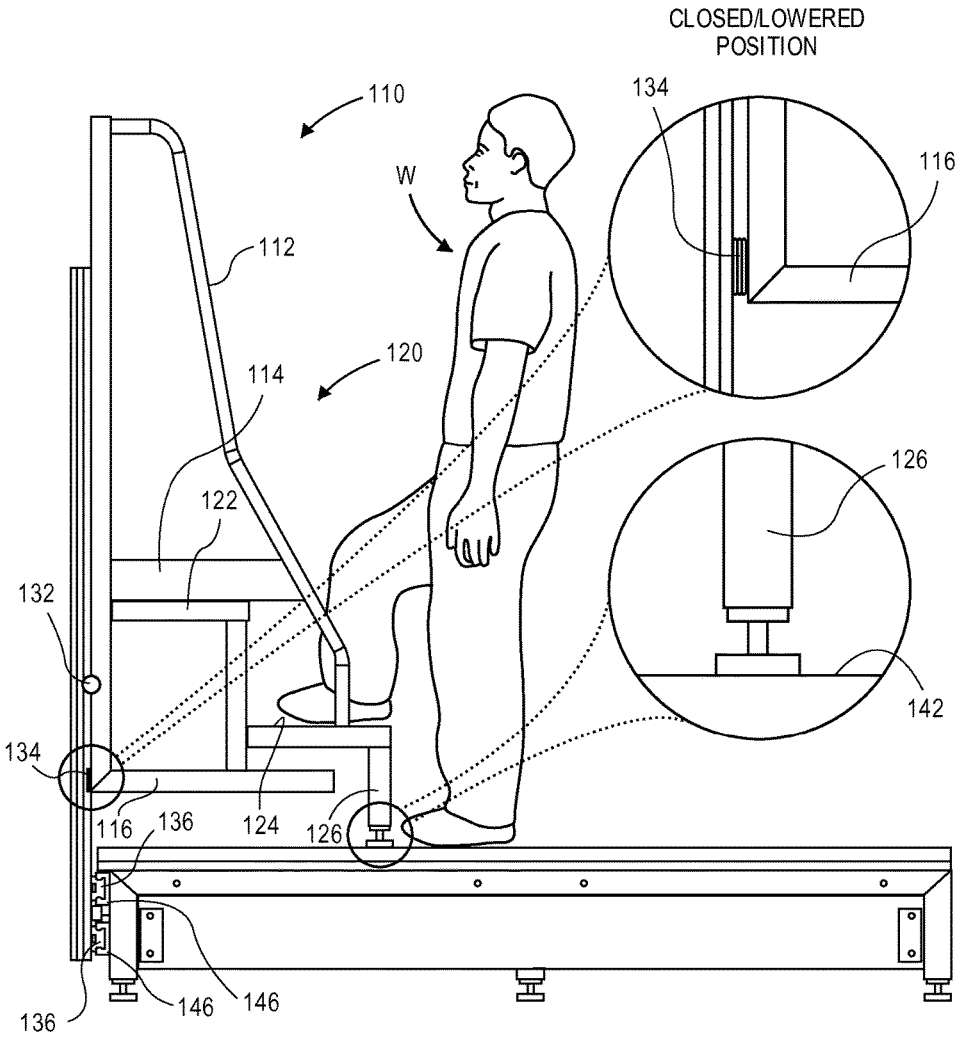

Referring to FIGS. 1A, 1B and 1C, a system 100 including a sliding ladder unit 110, a stair assembly 120, a mounting frame 130 and a platform assembly 140 are shown. The sliding ladder unit 110 includes a pair of handrails 112, an upper frame member 114, a lower frame member 116 and a back plate 118. As is shown in FIG. 1A, the sliding ladder unit 110 is formed integral to the stair assembly 120, which includes an upper stair 122, a lower stair 124 and a compressive stair support 126. The sliding ladder unit 110 and the stair assembly 120 are joined to the platform assembly 140 by the mounting frame 130, which includes a hinge 132, e.g., a bearing block 133*a* and shaft 133*b*, that defines an axis about which portions of the sliding ladder unit 110, viz., at least the stair assembly 120, may rotate with respect to the mounting frame 130, and a plurality of roller assemblies 136 including rotatable implements or rollers. The mounting frame 130 further includes a spring element 134 or other biasing element, which provides a spring force to the lower frame member 116, e.g., in a lateral direction, to resist rotation of the sliding ladder unit 110. The platform assembly 140 includes a deck 142, a plurality of legs 144 and a plurality of flanged tracks 146 configured to receive one or more of the rotatable implements or rollers provided in the roller assemblies 136 of the mounting frame 130.

The hinged connections of the sliding ladder units disclosed herein, e.g., connections between the stair assemblies or riser assemblies and the mounting frames, may be formed in any manner that permits portions of the sliding ladder units to rotate between a position in which a support or other element (e.g., a footing, a roller or another like compressive support) is elevated above a floor, a deck, a working surface or another portion of a platform assembly, and another position in which the support or other element is in contact with the floor, the deck, the working surface or the other portion of the platform assembly. The hinged connections may be formed by or from traditional hinges or like components, or by any other machine element that permits or enables a pure rotation or twist about a screw axis with a zero pitch, e.g., one or more linkages or compliant mechanisms. In some embodiments, the hinged connections may be formed by one or more bearing blocks or like components, e.g., assemblies including mounted bearings and pillow blocks, plummer blocks or other bearing housings that are configured to accommodate a rotatable shaft mounted to another object.

In this manner, the hinged connections enable portions of the sliding ladder units to rotate or pivot about an axis between an open or raised position and a closed or lowered position. Such portions may include one or more machine elements that permit screw motions of zero or infinite pitches, and any combination of such motions. e.g., elements or components that are characterized by revolute and/or prismatic joint, as well as elements that are configured to couple translations and rotations. In the open or raised position, a sliding ladder unit is not loaded with the mass of a worker or one or more other objects, and one or more supports or extensions of the sliding ladder unit does not come into contact with a floor, a deck, a working surface or another portion of a platform assembly. In the closed or lowered position, the sliding unit is loaded with the mass of a worker or one or more other objects, and the one or more supports or extensions of the sliding ladder unit are pressed into the floor, the deck or working surface, which provides structural support for the mass of the worker by way of the one or more supports or extensions of the sliding ladder unit.

Referring to FIG. 1B, the sliding ladder unit 110 of FIG. 1A is shown in an open or raised position. As is shown in FIG. 1B, the sliding ladder unit 110 is not loaded, e.g., there are no workers or objects on either of the stairs 122, 124 of the stair assembly 120. Accordingly, the spring element 134 provides sufficient lateral force to the sliding ladder unit 110, by way of the lower frame member 116, to keep the stair support 126 elevated above the deck 142 at a height $\Delta h$. More specifically, the moment about the axis defined by the hinge 132 that is generated by the mass of sliding ladder unit 110 is not sufficient to overcome the moment about the axis that is generated by the lateral spring force provided by the spring element 134. Therefore, with the sliding ladder unit 110 in the open or raised position, and the stair support 126 elevated above the deck 142, the sliding ladder unit 110 may be easily translated along the edge of the platform assembly 140 to which the sliding ladder unit 110 is mounted, with limited friction.

Referring to FIG. 1C, the sliding ladder unit 110 of FIG. 1A is shown in a closed or lowered position. As is shown in FIG. 1C, when a worker W steps onto one of the stairs 122, 124 of the stair assembly 120, the sliding ladder unit 110 rotates in a manner that compresses the spring element 134 between the mounting frame 130 and the lower frame member 116, and causes the stair support 126 to come into contact with the deck 142. More specifically, the sum of the moment about the axis defined by the hinge 132 that is generated by the mass of the sliding ladder unit 110 and the force provided by the worker Won the lower stair 124 exceeds the moment about the axis that is generated by the lateral spring force provided by the spring element 134. Therefore, with the sliding ladder unit 110 in the closed or lowered position, and the stair support 126 in contact with the deck 142, the sliding ladder unit 110 has additional structural support for supporting the weight of the worker Wand any tools, items or other objects that he or she may transport thereon.

Ladders are commonly used in industrial or commercial environments, such as a materials handling facility, a department store or a library, in order to enable workers to access facilities, machines, consoles, storage units (e.g., shelves, racks, mezzanines, bars, platforms, bins, cabinets or drawers) or other elements that are located beyond a reasonable reach from a ground or walking level. A typical ladder includes two or more rails having at least one riser such as a stair or rung, e.g., a platform of suitable dimensions that is sufficiently durable to accommodate the weight of at least one worker and one or more tools, raw materials or other objects, provided therebetween.

The rails and risers of a ladder may be formed of any sufficiently strong and appropriately sized materials, such as wood, plastics (e.g., reinforced plastics such as fiberglass), metals (e.g., forged steel or aluminum) or composites. Additionally, the rails and risers may include one or more safety features or elements. For example, a ladder rail may be covered entirely or in part by a padded grip section formed from plastics or rubbers (e.g., neoprene or polychloroprene) that enables a user to more easily grasp the rails when ascending or descending the ladder. Additionally, a ladder riser may be formed of a solid material, or, alternatively, may include one or more holes, perforations or grates, or materials having enhanced treads. Such features may inhibit the formation or accumulation of slick materials such as water, ice or oils, which may create one or more slip hazards or skid hazards to workers ascending or descending the ladders. Moreover, a safety cage or like feature may encompass all or a portion of an erected ladder, thereby providing enhanced protection to one or more workers using the ladder. Furthermore, the various rails and risers of a ladder may be formed from a non-conductive material, or covered or layered with one or more insulators or insulating materials, when the ladder is intended for use in an environment having one or more active or live electrical wires or powered components that may come into contact with the ladder during use.

A ladder may be selected or provided for use in connection with any given task based at least in part on any operational features or characteristics thereof, including the height of the various rails or rungs of the ladder with respect to a height of the facilities, machines, consoles, storage units or other elements for which access is desired. Additionally, a ladder may be selected based on any other intrinsic or extrinsic factors such as the weather or other environmental conditions in the area in which the ladder is to be used, or the weights or masses of the workers who will ascend or descend the ladder, as well as the weights or masses of any tools, materials or objects that the workers may carry with them.

Various types of ladders are available for use by workers in industrial or commercial environments, by homeowners or tenants in a residential environment, or by any type or class of user in any other environment. For example, a standard, generic ladder typically includes a single pair of rails and a plurality of risers or stairs provided therebetween. The ladder may be leaned against another structure (e.g., a wall, a building or a storage unit), and a worker may ascend and descend the ladder in order to complete one or more tasks. A stepladder is a free-standing, self-supported ladder having two pairs of rails joined by a hinge at proximal ends of each of the pairs of rails, with risers provided between at least one of the pairs of rails. Because stepladders include pairs of rails joined by hinges, a stepladder may be used in any location with respect to an element to which access is desired. For example, the pairs of rails may be opened, and the stepladder may rest on the distal ends of each of the rails, within a vicinity of the element that a worker intends to access. Based on their construction, stepladders must be unfolded and folded in each location at which the use of the stepladder is desired.

An extension ladder typically includes two or more standard ladders joined to one another. A first ladder, which is sometimes called a "base" ladder, is configured to be placed on a ground or other operating surface, such as a floor or other platform. A second ladder, which is sometimes called a "fly" ladder, is an adjustable ladder that may be joined to the base ladder using one or more ropes, hooks, pawls or other elements for adjusting and fixing the overall height of the extension ladder. Once the desired height of the extension ladder is established, the extension ladder may be leaned against a structure (e.g., a wall, a building or a storage unit), and a worker may ascend and descend the ladder in order to complete one or more tasks. Thus, an extension ladder has a theoretical maximum height defined by a sum of the lengths of the base ladder and any fly ladders provided thereon and, like a stepladder, an extension ladder must be expanded and contracted in each location at which the use of the extension ladder is desired.

Additionally, ladders may include a combination of one or more pairs of rails and risers, as well as platforms at various elevations, and bars, grips or other safety barriers. For example, a ladder may lead to one or more platforms or other levels on which a worker may perambulate while performing one or more tasks. Similarly, ladders may include one or more other extensible, folding or telescoping features that may allow a worker to adjust the height of one or more risers, platforms or other elements, and to increase the functionality of such ladders.

Despite the many functional advancements and safety features that are commonly used in modern ladders, the effectiveness of a ladder for use in multiple areas or locations of a working environment such as a materials handling facility is frequently limited. For example, a worker who intends to use a ladder to perform a given task in multiple areas or locations must first assemble (e.g., unfold, extend, erect or expand) the ladder in a first area or location where use of the ladder is desired, perform the task using the ladder in the first area or location, then disassemble the ladder, transport the ladder to a second area or location where use of the ladder is desired, and reassemble the ladder there. The convenience and utility that a ladder provides in terms of enabling a worker to access higher elevations for the performance a task is mitigated when the worker must perform the task in multiple areas or locations, e.g., depositing items in or retrieving items from multiple shelving units at varying locations and elevations within a materials handling facility, by the need to repeatedly transport, assemble and disassemble the ladder wherever the task must be performed.

The systems and methods of the present disclosure are directed to sliding ladder units that may be easily transported between and among various locations in order to enable the performance of one or more tasks at such locations. The sliding ladder units disclosed herein include one or more risers, stairs or other like elements that are joined to a floor, a platform or other accessible area by a rolling or translatable element, e.g., a track roller assembly or carriage having rollable or slidable elements, including but not limited to one or more cam followers or V-groove bearings joined to a backplate or other element that may be received in a track or rail provided in or on the floor, on the platform or other accessible area, and which enable the sliding ladder unit to slide or translate along an edge or face of the floor or platform from one location to another while constraining motion of the sliding ladder unit to a linear direction defined by the track or rail.

Additionally, the sliding ladder units may be joined to the floor, the platform or other accessible area in a hinged manner, e.g., with one or more machine elements or components that permit screw motions of zero or infinite pitches, and any combination of such motions, including but not limited to elements or components that are characterized by revolute and/or prismatic joints, as well as elements or components that are configured to couple translations and rotations, such that one or more structural supports or contact footings of the sliding ladder units are raised or elevated above the floor or platform when the sliding ladder unit is not loaded or subjected to the weight of a worker or one or more objects. When a sliding ladder unit is not so loaded, the weight of the sliding ladder unit itself may be adequately supported by the rolling or translatable elements, and the sliding ladder units may be slid or translated between different locations on the platform quickly, efficiently, and in a low-friction manner. When the sliding ladder unit is loaded by the weight of a worker or one or more objects, however, the one or more structural supports or contact footings may come into contact with the floor or platform, and the weight of the sliding ladder unit, the worker and/or the one or more objects may be adequately supported by both the rolling or translatable elements and the structural supports or contact footings of the sliding ladder unit.

In some embodiments, a sliding ladder unit may rotate between an open or raised position and a closed or lowered position with respect to a floor, a platform or platform assembly to which the sliding ladder unit is mounted, based on the amount or extent to which the sliding ladder unit is loaded with the weight of a worker or one or more objects. The sliding ladder unit may be mounted to the floor, the platform or platform assembly by a mounting frame having a connection that enables the sliding ladder unit to rotate about an axis defined thereby between the open or raised position and the closed or lowered position. The connection may be formed by any machine element, such as a hinge, that permits a pure rotation or twist about a screw axis with a zero pitch. In this regard, the sliding ladder units of the present disclosure may translate in a single degree of freedom in an open or raised position, e.g., when the sliding ladder units are in an unloaded condition, and may be locked into place with zero degrees of freedom in a closed or lowered position, e.g., when the sliding ladder units are in a loaded condition.

Additionally, the mounting frame may further include a biasing element, such as a spring, that may be aligned to provide a force that resists the rotation of the sliding ladder unit from the open or raised position into the closed or lowered position. In this regard, the biasing element may have one or more dimensions or attributes, e.g., a spring constant, that are selected to provide an adequate spring force, and a moment generated thereby, for maintaining the sliding ladder unit supports or footings above the floor or platform when the sliding ladder unit is not loaded by the weight of a worker or another object. The dimensions or attributes of the biasing element may also be selected such that the spring force and moment, when the sliding ladder unit is loaded by a nominal or traditional weight of a worker and/or one or more objects (e.g., a nominal sum such as one hundred pounds, or 100 lbs.), may be overcome by a moment generated thereby, and the sliding ladder unit supports or footings may be placed into contact with the floor or platform. Such supports or footings may then provide, by way of the floor or platform, adequate structural support for the sliding ladder unit and the worker and/or objects thereon while the use of the ladder in a given location is desired. When the use of the ladder in the given location is no longer desired, and the weight of the worker or the object is removed from the ladder, the spring force and moment of the biasing element may then lift the supports or footings above the floor or platform, and enable the sliding ladder unit to be moved or translated to another location in a low-friction manner.

The ability to easily move a sliding ladder unit of the present disclosure from one location to another location is particularly valuable where a number of tasks having brief durations are to be performed at heightened elevations in locations that are near to or in series with one another. In such situations, a sliding ladder unit of the present disclosure may be provided on a floor or platform adjacent to such locations, such that a worker may quickly position the sliding ladder unit in a first location, ascend the sliding ladder unit and complete a first one of a plurality of tasks, before descending the sliding ladder unit, repositioning the sliding ladder unit to a second location and ascending the sliding ladder unit to complete a second one of the tasks.

For example, in a materials handling facility such as a fulfillment center, a sliding ladder unit may be provided on a floor, a platform or another location with respect to a shelving unit or, alternatively, a loading station at which a plurality of autonomous mobile robots transporting shelving units may be positioned or parked. In such situations, a worker may ascend a sliding ladder unit to deposit one or more items onto the shelving unit or into a bin or other storage area of the autonomous mobile robots, or retrieve one or more items from the shelving unit or from one or more bins or storage areas of the autonomous mobile robots, before repositioning the sliding ladder unit to a different location and repeating the process. One or more attributes of the sliding ladder unit, e.g., a number, a size or an elevation of one or more of the stairs or risers thereon, may be selected based on one or more attributes of the shelving unit or storage area, e.g., heights of one or more shelves or bins thereon.

Figure 2A:
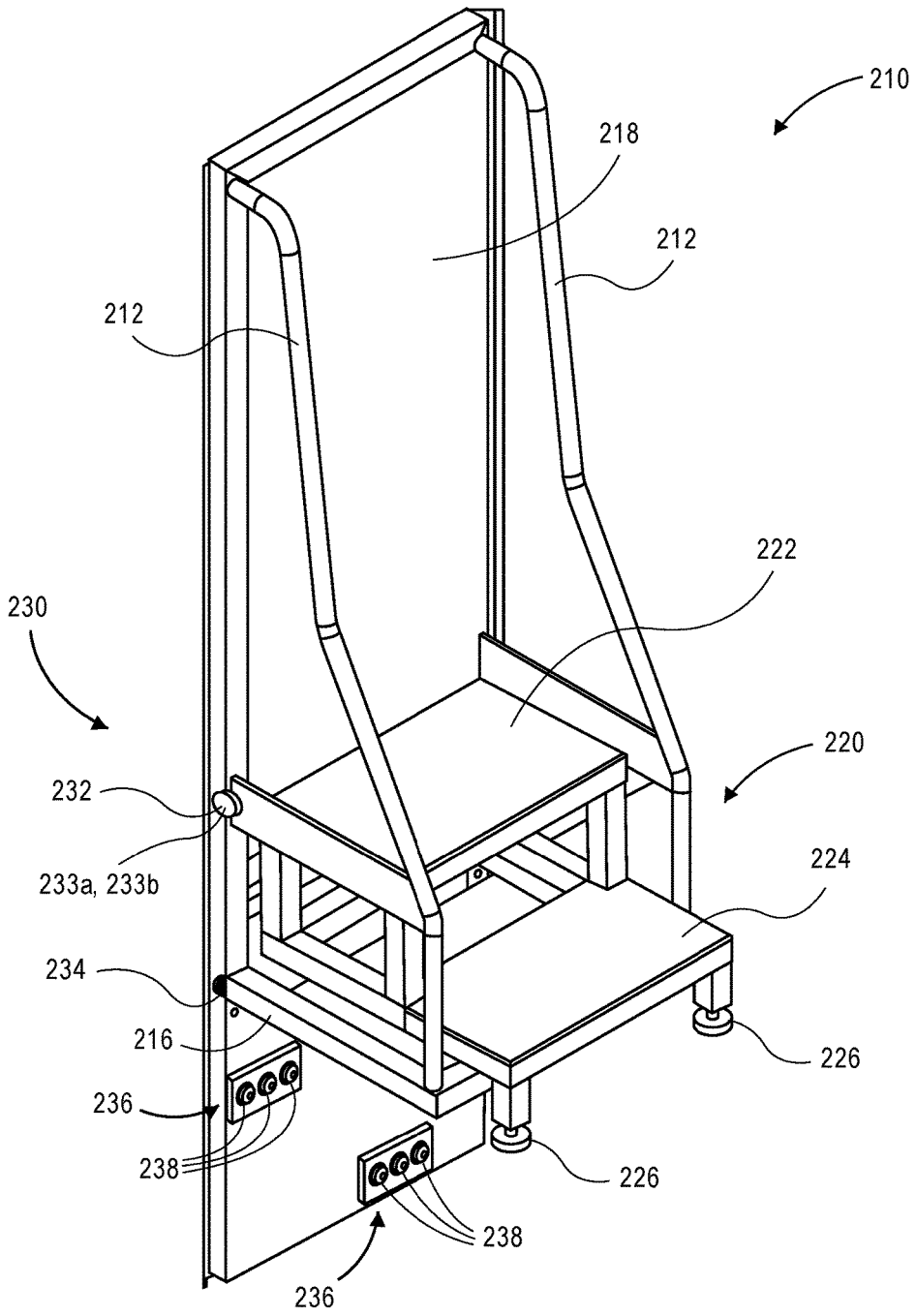
Figure 2B:
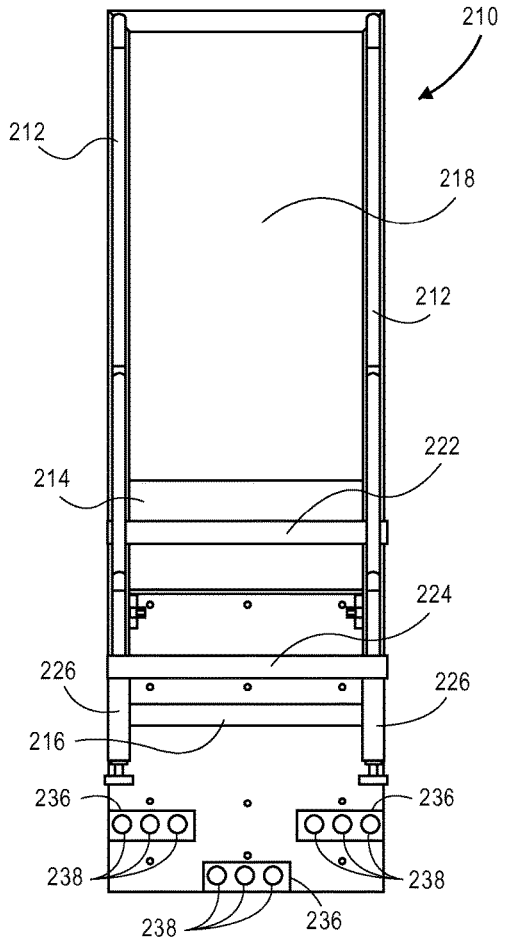
Figure 2C:
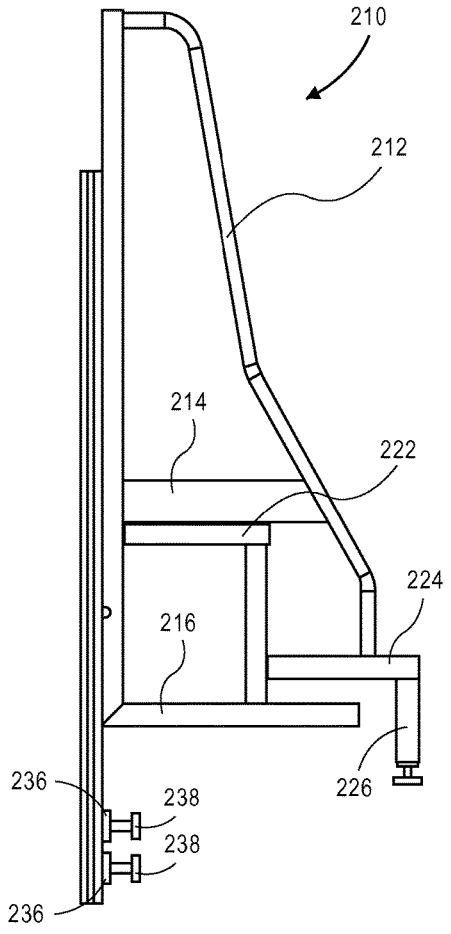

Referring to FIGS. 2A, 2B and 2C, one embodiment of a sliding ladder unit 210 of the present disclosure is shown. Except where otherwise noted, reference numerals preceded by the number "2" shown in FIGS. 2A through 2C indicate components or features that are similar to components or features having reference numerals preceded by the number "1" shown in FIGS. 1A through 1C.

FIG. 2A is a perspective view of the sliding ladder unit 210, while FIG. 2B is a front view of the sliding ladder unit 210, and FIG. 2C is a side view of the sliding ladder unit 210. As is shown in FIGS. 2A, 2B and 2C, the sliding ladder unit 210 includes a pair of handrails 212, an upper frame member 214, a lower frame member 216 and a backing 218. The handrails 212 may be formed of any suitable material, e.g., plastic, wood, steel or aluminum, and may include one or more external coatings or coverings provided for any purpose, including comfort, safety, or insulation against heat or electrical currents.

As is shown in FIGS. 2A, 2B and 2C, the handrails 212 are joined directly to the backing 218 at an upper portion of the sliding ladder unit 210, and extend downward in an angled manner before joining the upper frame member 214 and ending at the lower frame member 216. Although the handrails 212 of FIG. 2A are shown as having a tubular or cylindrical shape, those of ordinary skill in the pertinent arts will recognize that such handrails may take any shape or form, and have sections oriented at one or more angles with respect to the backing 218 or any other elements of the sliding ladder unit 210. Additionally, the backing 218 may act as a barrier between a worker on the sliding ladder unit 210 and any facilities, machines, consoles or storage units with which the sliding ladder unit 210 is associated, and may be solid, meshed, slatted or open, e.g., including simply a frame to which the handrails 212 may be mounted.

As is also shown in FIGS. 2A, 2B and 2C, the sliding ladder unit 210 includes a stair assembly 220 having a pair of stairs or risers 222, 224 and one or more contact footings 226. The stairs or risers 222, 224 may be sized or selected based on the applications for which the sliding ladder unit 210 is intended. Additionally, although the stair assembly 220 includes two stairs or risers 222, 224, those of ordinary skill in the pertinent art will recognize that the sliding ladder units of the present disclosure may include any number of stairs or risers. For example, where the sliding ladder unit 210 is to be used in connection with a warehouse or other materials handling facility to load materials into or remove items from two or more substantially high shelving units, a greater number of stairs or risers 222, 224 may be provided. Additionally, the dimensions of the stairs or risers 222, 224 may also be selected on any basis, including the sizes of the feet of the one or more workers who may be expected to ascend or descend the stairs or risers 222, 224, or any operational constraints associated with the tasks to be performed by such workers, as well as any structural requirements.

As is further shown in shown in FIGS. 2A, 2B and 2C, the sliding ladder unit 210 includes a mounting frame 230 having a hinged connection 232, one or more springs 234 or other biasing elements (e.g., compression springs) and a plurality of roller assemblies 236 having a plurality of rollers 238. The mounting frame 230 is provided to join the sliding ladder unit 210 to a floor, a platform assembly or other like component (not shown) in a rolling or translatable manner by way of the roller assemblies 236. The hinged connection 232 may include one or more machine elements that permit pure rotations or twists about screws or screw axes with zero pitch, such as a bearing block 233*a* and shaft 233*b* or other like components, such as a pin and bushing, and enable at least the stair assembly 220 to rotate with respect to the mounting frame 230.

The springs 234 may be any type of deflectable extension or compression device capable of absorbing forces in extension or compression and returning a reciprocal force, or spring force, on the stair assembly 220 by way of the lower support member 226 that is proportional to an extent of deflection and in a direction opposite to the deflection. The spring force exerted by the springs 234 is typically a product of a spring constant and the extent of the deflection. In some embodiments, the springs 234 may be standard metal coil springs mounted to the mounting frame 230 and aligned to come into contact with all or a portion of the stair assembly 220 or the lower frame member 216 in compression. Alternatively, the springs 234 may be standard metal coil springs that are mounted to the upper frame member 214, the lower frame member 216 or the mounting frame 230 and one or more elements of the stair assembly 220, and aligned to resist relative motion or rotation in tension. In some other embodiments, the springs 234 may be low-load plastic compression springs formed from plastics or polymers such as a polyester-based elastomer that are joined to the mounting frame 230 using one or more bolts, fasteners or other like means. In still other embodiments, the springs 234 may have a substantially cylindrical shape with an outer diameter of approximately one-and-one-half inches (1.5") and a height of approximately one-and-one-quarter inches (1.25") when not compressed, and an outer diameter of approximately two inches (2") and a height of approximately one-half inch (0.5") when compressed. The springs 234 may also be extension springs, torsion springs, leaf springs or any other linear or non-linear displacement device in accordance with the present disclosure.

Additionally, the placement of the springs 234 with respect to the hinged connection 232 ensures that the spring force will exert a moment on at least the stair assembly 220 about an axis defined by the hinged connection 232. Conversely, when the sliding ladder unit 210 is unloaded, the mass of at least the stair assembly 220 also exerts a moment defined as a function of the distance between the hinged connection 232 and a center of gravity of at least the stair assembly 220. When the stair assembly 220 is loaded with one or more workers or objects placed on one or more of the stairs or risers 222, 224, the weight of the workers or objects also exerts a moment defined as a function of a distance between the hinged connection 232 and the locations at which the workers or objects are placed on one or more of the stairs or risers 222, 224. Moreover, in some embodiments, the hinged connection 232 may incorporate or include one or more of the springs 234 (e.g., a torsion spring provided about a hinge).

The roller assemblies 236 are provided in order to mount the mounting frame 230 and, by extension, the sliding ladder unit 210 as a whole, to a floor, a platform or other like component (not shown). The roller assemblies 236 shown in FIGS. 2A, 2B and 2C each include a plurality of rollers 238 or other rolling bearing units (e.g., crown rollers or radial wheels) that are configured to mate with one or more tracks or other surfaces provided on the floor, the platform or other like component to which the mounting frame 230 is mounted. As is shown in FIGS. 2A, 2B and 2C, the roller assemblies 236 and the rollers 238 may be aligned in parallel and horizontally, thereby enabling the sliding ladder unit 210 to slide or translate horizontally when the mounting frame 230 is mounted to the platform or other like component. In some embodiments, the bearing blocks may include not only the rollers 238 but also one or more spring-loaded casings or seals therein. Additionally, the rollers 238 may have smooth rolling surfaces, or may include one or more grooves therein for mating with a corresponding ridge or like feature within a track or other guide provided on a floor, a platform or other like component.

As is discussed above, any type of biasing element or spring element may be utilized in order to generate a force that elevates at least a portion (e.g., one or more supports) of a sliding ladder unit above a floor, a platform or another surface when the sliding ladder unit is not loaded, yet may be overcome when the sliding ladder unit is loaded with the mass of one or more workers or objects. For example, as is shown in FIGS. 2A through 2C, the sliding ladder unit 210 includes one or more compression springs 234 that are aligned to provide a spring force in compression that is proportional to an extent of deflection and in a direction opposite to the deflection of the stair assembly 220 toward the mounting frame 230. Alternatively, an extension spring may be provided to provide a spring force in tension that is proportional to an extent of deflection and in a direction opposite to the deflection of a stair assembly away from a mounting frame.

Figure 3A:
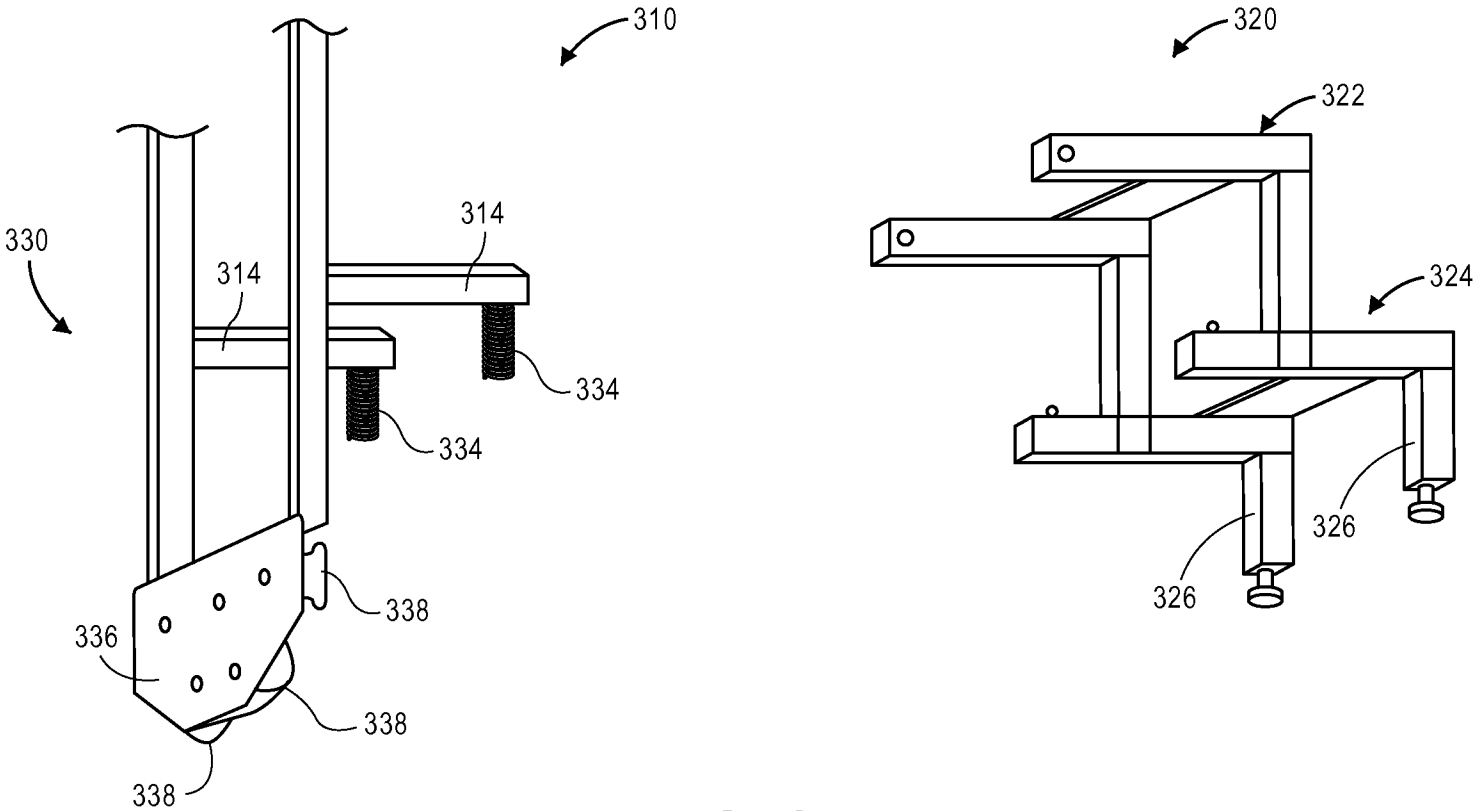
Figure 3B:
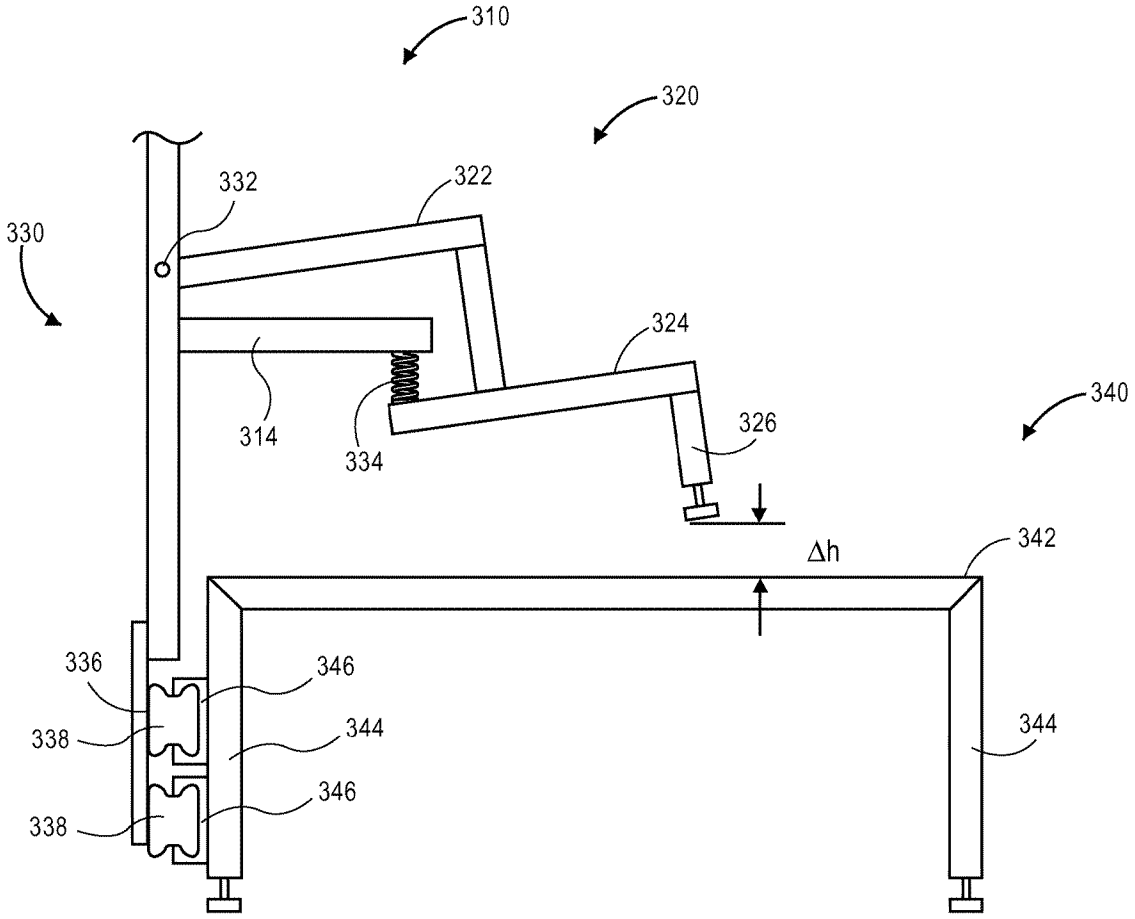
Figure 3C:
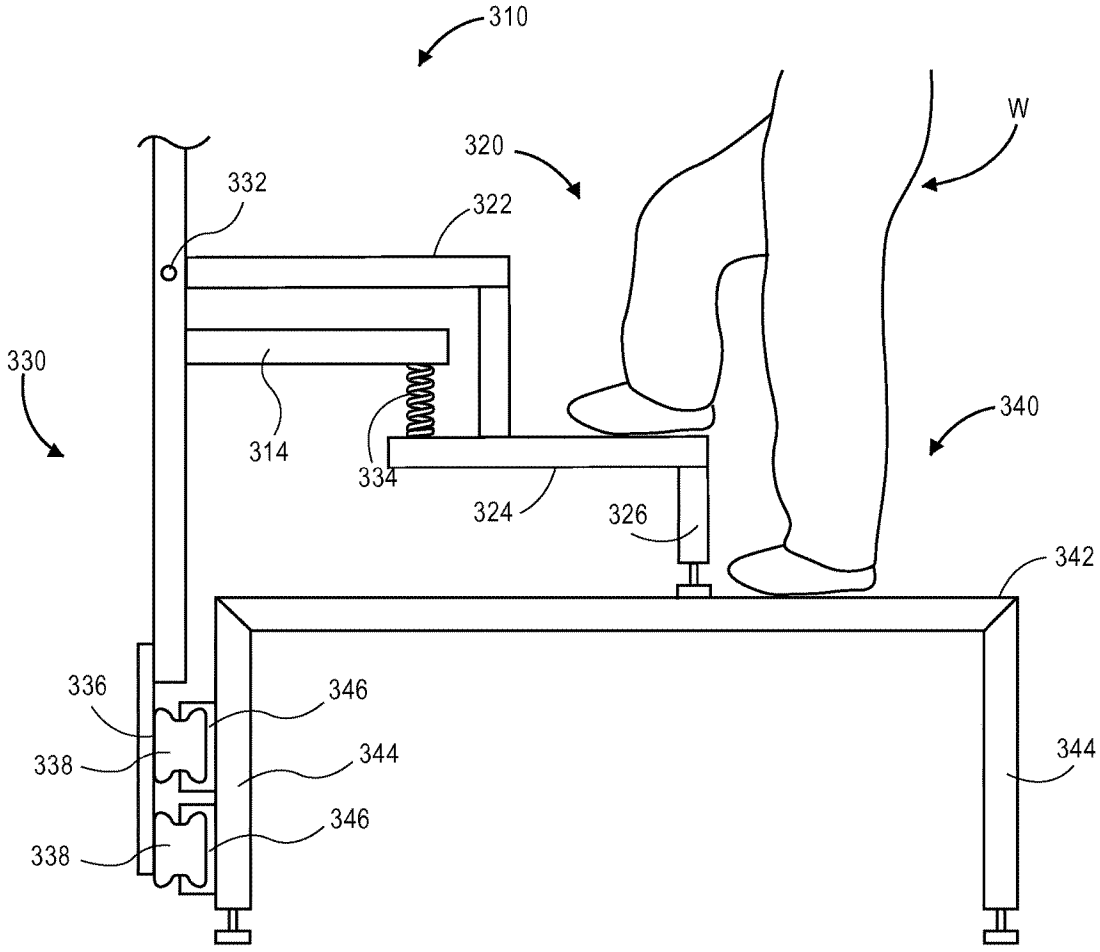

Referring to FIGS. 3A, 3B and 3C, one embodiment of a sliding ladder unit 310 of the present disclosure is shown. Except where otherwise noted, reference numerals preceded by the number "3" shown in FIGS. 3A through 3C indicate components or features that are similar to components or features having reference numerals preceded by the number "2" shown in FIGS. 2A through 2C, or by the number "1" shown in FIGS. 1A through 1C.

FIG. 3A is a rear perspective view of portions of the sliding ladder unit 310, including a stair assembly 320 (or riser assembly) and a mounting frame 330. The stair or riser assembly 320 includes a first stair or riser 322, a second stair or riser 324 and a pair of supports or footings 326. The mounting frame 330 includes a pair of upper frame members 314 having extension springs 334 joined thereto, and a roller assembly 336 having a plurality of rollers 338.

When the stair assembly 320 and the mounting frame 330 are joined to one another at a hinged connection 332, the extension springs 334 may resist movement or rotation of the stair assembly 320 with respect to the mounting frame. Referring to FIG. 3B, a side view of the sliding ladder unit 310 in an open or raised position is shown. The sliding ladder unit 310 is mounted to a platform assembly 340 having a deck 342, a plurality of platform supports 344 and a pair of tracks 346 for accommodating the rollers 338 of the roller assembly 336. Because the sliding ladder unit 310 is not loaded, the supports or footings 326 of the stair assembly 320 are elevated above the deck 342, by a biasing force provided by the extension springs 334.

Referring to FIG. 3C, a side view of the sliding ladder unit 310 in a closed or lowered position is shown. The sliding ladder unit 310 is loaded with the weight of a worker W, which may overcome the biasing force provided by the extension springs 334, and cause the supports or footings 326 of the stair assembly 320 to come into contact with the deck 342. With the weight of the worker W loaded onto the sliding ladder unit 310, the sliding ladder unit 310 is thus effectively locked into place.

Figure 4:
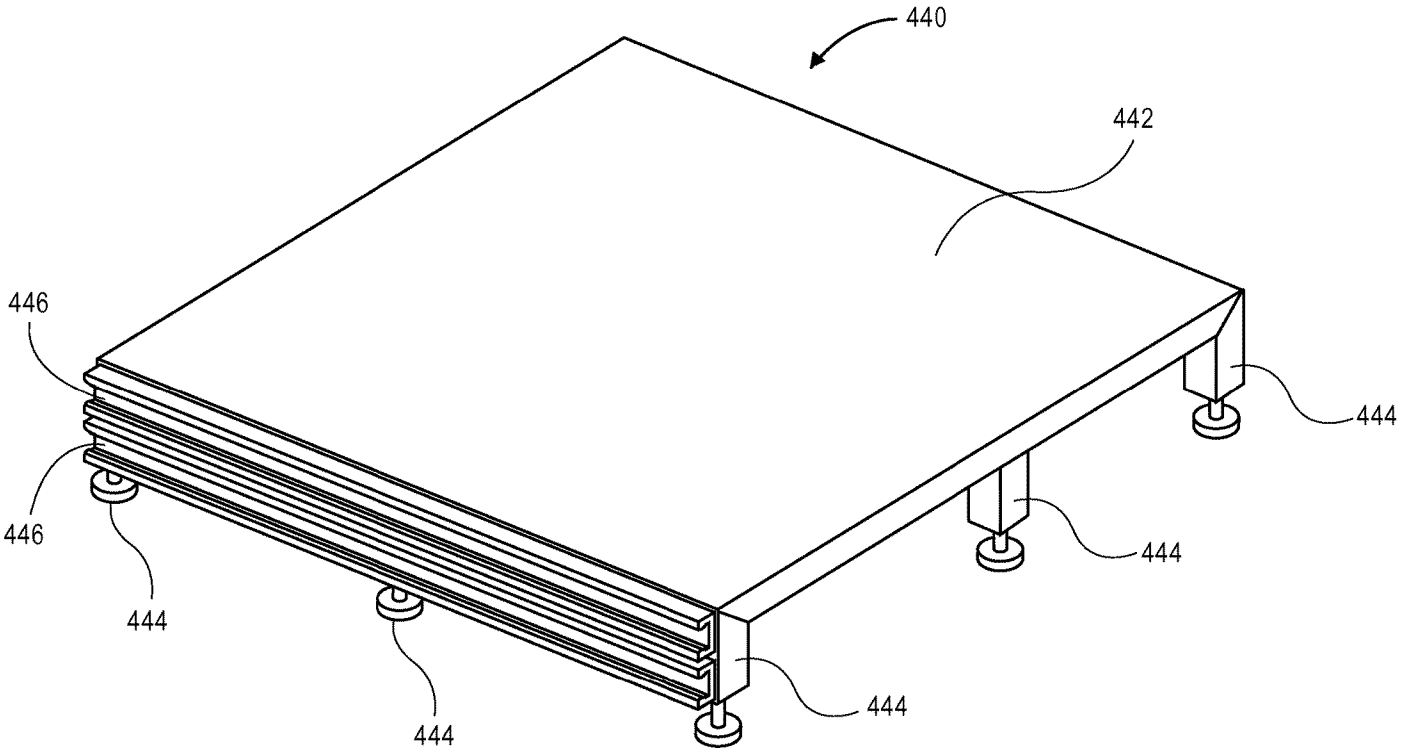
FIG. 4 is a view of components of one system configured for use with a sliding ladder unit in accordance with embodiments of the present disclosure, in which a platform assembly is shown to which a sliding ladder unit may be mounted.

Referring to FIG. 4, a platform assembly 440 to which one or more embodiments of a sliding ladder unit of the present disclosure may be mounted is shown. Except where otherwise noted, reference numerals preceded by the number "4" shown in FIG. 4 indicate components or features that are similar to components or features having reference numerals preceded by the number "3" shown in FIGS. 3A through 3C, by the number "2" shown in FIGS. 2A through 2C or by the number "1" shown in FIGS. 1A through 1C.

As is shown in FIG. 4, the platform assembly 440 includes a deck 442 or other raised surface area on which one or more workers may travel or complete one or more tasks. The deck 442 may be formed from one or more plates, panels, grates or slabs, and may be solid, meshed or slatted. Additionally, the platform assembly 440 further includes a plurality of legs 444 and a set of tracks 446. The legs 444 are mounted around or beneath the deck 442 and are intended to provide structural support for the deck 442, as well as any workers or other objects provided thereon or mounted thereto, such as a sliding ladder unit (not shown), at an elevation higher than the ground or other surface on which the platform assembly 440 is provided.

The set of tracks 446 are defined channels or linear guides provided on at least one side of the platform assembly 440. The tracks 446 are configured to receive at least a portion of a roller assembly or other extension, such as the rollers 238 of the roller assemblies 236 of FIGS. 2A, 2B and 2C, or the rollers 338 of the roller assembly 336 of FIGS. 3A, 3B and 3C, provided on a mounting frame or other element of a sliding ladder unit. When one or more rollers or roller assemblies mounted to a mounting frame are provided within the tracks 446, the mounting frame may slide laterally in a direction parallel to the tracks 446 between or among two or more locations in order to enable workers to access areas or stations provided at elevations that are higher than the level of the deck 442. According to some embodiments, the tracks 446 may be formed of a steel or aluminum and include one or more rails or inserts for receiving or guiding rollers or other elements of bearing blocks or like devices therein. Additionally, although the deck 442 and the platform assembly 440 of FIG. 4 are shown as substantially rectangular in shape, those of ordinary skill in the pertinent arts will recognize that the sliding ladder units of the present disclosure may be provided for use in connection with decks or platforms of any shape, and may be mounted to such decks or platforms on non-linear or non-planar edges or faces, e.g., on one or more curved tracks provided on such edges or faces.

As is discussed above, the rolling or translatable mountings of the sliding ladder units disclosed herein to one or more platforms provide adequate structural support in a vertical direction to such sliding ladder units, and enable such sliding ladder units to translate between two or more positions on such platforms in a substantially frictionless or low-friction manner, when the sliding ladder units are not loaded. The hinged and spring-resistive manner in which a stair or riser assembly or other elements of the sliding ladder units disclosed herein may be mounted to a platform thus enables a worker to use sliding ladder unit when performing one or more tasks, e.g., depositing items in or retrieving items from storage units, in different locations.

Figure 5A:
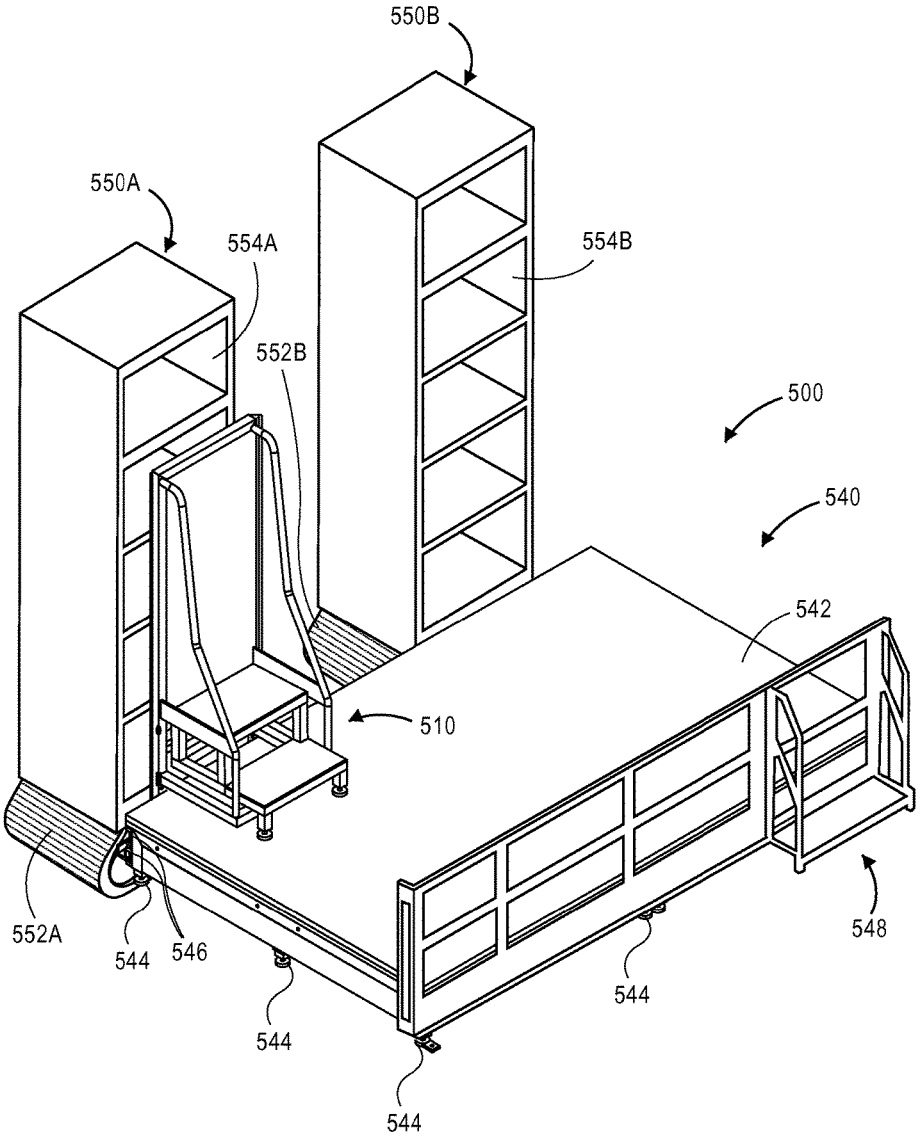
Figure 5B:
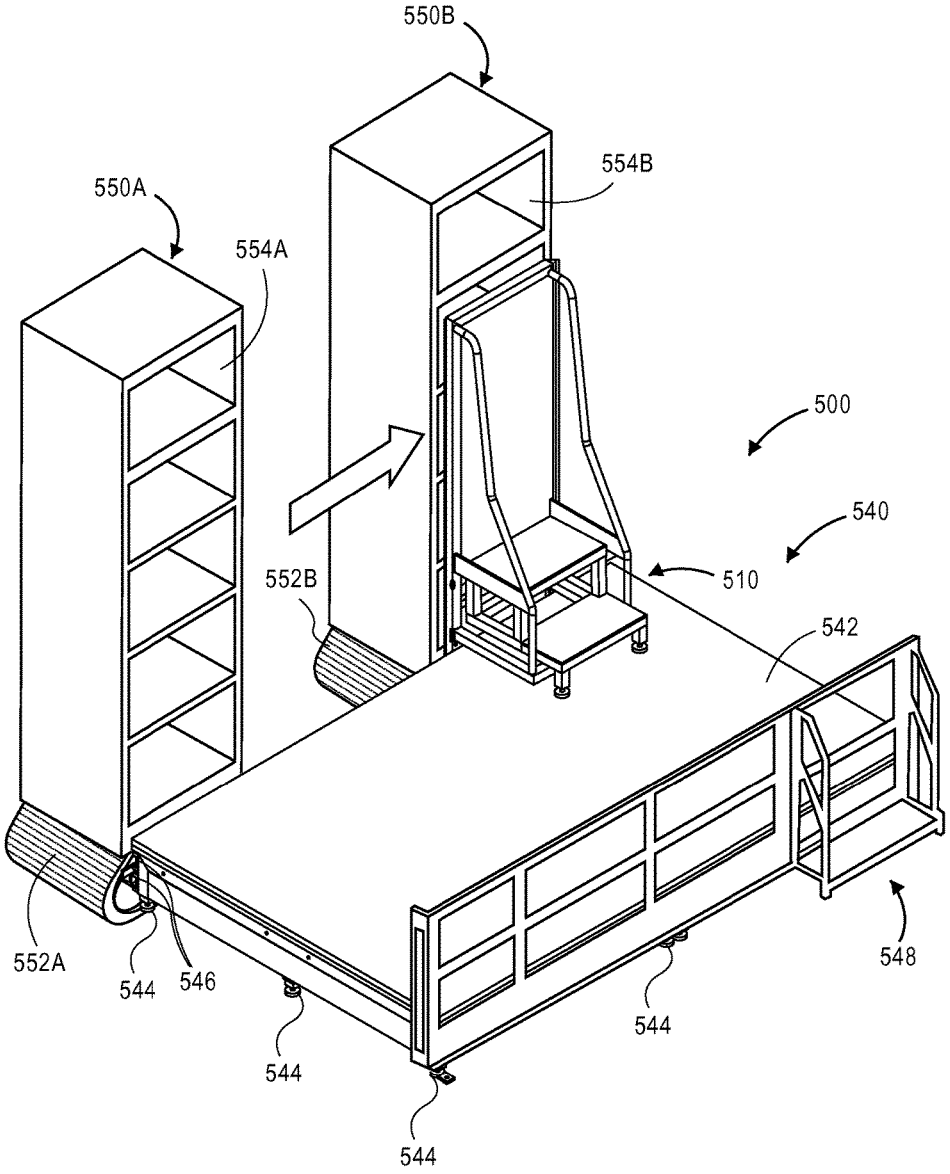

Referring to FIG. 5A and FIG. 5B, views of components of one system 500 including a sliding ladder unit 510 in accordance with embodiments of the present disclosure are shown. Except where otherwise noted, reference numerals preceded by the number "5" shown in FIGS. 5A and 5B indicate components or features that are similar to components or features having reference numerals preceded by the number "4" shown in FIG. 4, by the number "3" shown in FIGS. 3A through 3C, by the number "2" shown in FIGS. 2A through 2C or by the number "1" shown in FIGS. 1A through 1C.

Referring to FIG. 5A, the system 500 includes the sliding ladder unit 510, a platform assembly 540 and a pair of autonomous mobile robots 550A, 550B. The sliding ladder unit 510 is mounted to an edge of the platform assembly 540 in a vicinity of an area that receives the autonomous mobile robots 550A, 550B. The platform assembly 540 includes a deck 542 or other platform, a plurality of legs 544 provided around the deck 542, a pair of parallel tracks 546 to which the sliding ladder unit 510 is mounted using a bearing block or other like device having one or more rollers or rolling implements (not shown), and a gated stairway 548 by which one or more workers may access the deck 542 and the sliding ladder unit 510. The autonomous mobile robots 550A, 550B include mobile drive units 552A, 552B and inventory holders 554A, 554B having a plurality of bins provided thereon. As is shown in FIG. 5A, the autonomous mobile robots may be received, parked or stationed alongside the edge of the deck 542 to which the sliding ladder unit 510 is mounted.

In accordance with the present disclosure, the sliding ladder unit 510 may be used by one or more workers to perform tasks in a vicinity of locations that may be located within a vicinity of one another, such as loading items into or unloading items from one of the inventory holders 554A, 554B on the autonomous mobile robots 550A, 550B, and repositioned to a different location in order to load items into or unload items from the other of the inventory holders 554A, 554B on the autonomous mobile robots 550A, 550B. Referring to FIG. 5B, the sliding ladder unit 510 is shown as having been repositioned, e.g., by translating the sliding ladder unit 510 along the parallel tracks 546, from a location in front of the autonomous mobile robot 550A to a location in front of the autonomous mobile robot 550B. When the sliding ladder unit 510 is not loaded with any workers or other objects, the sliding ladder unit 510 may slide along the tracks quickly and efficiently, and in a substantially low-friction manner. After the sliding ladder unit 510 has been appropriately repositioned, and the sliding ladder unit 510 is loaded with a worker and/or one or more objects, the sliding ladder unit 510 is adequately supported by the platform 542.

Figure 6A:
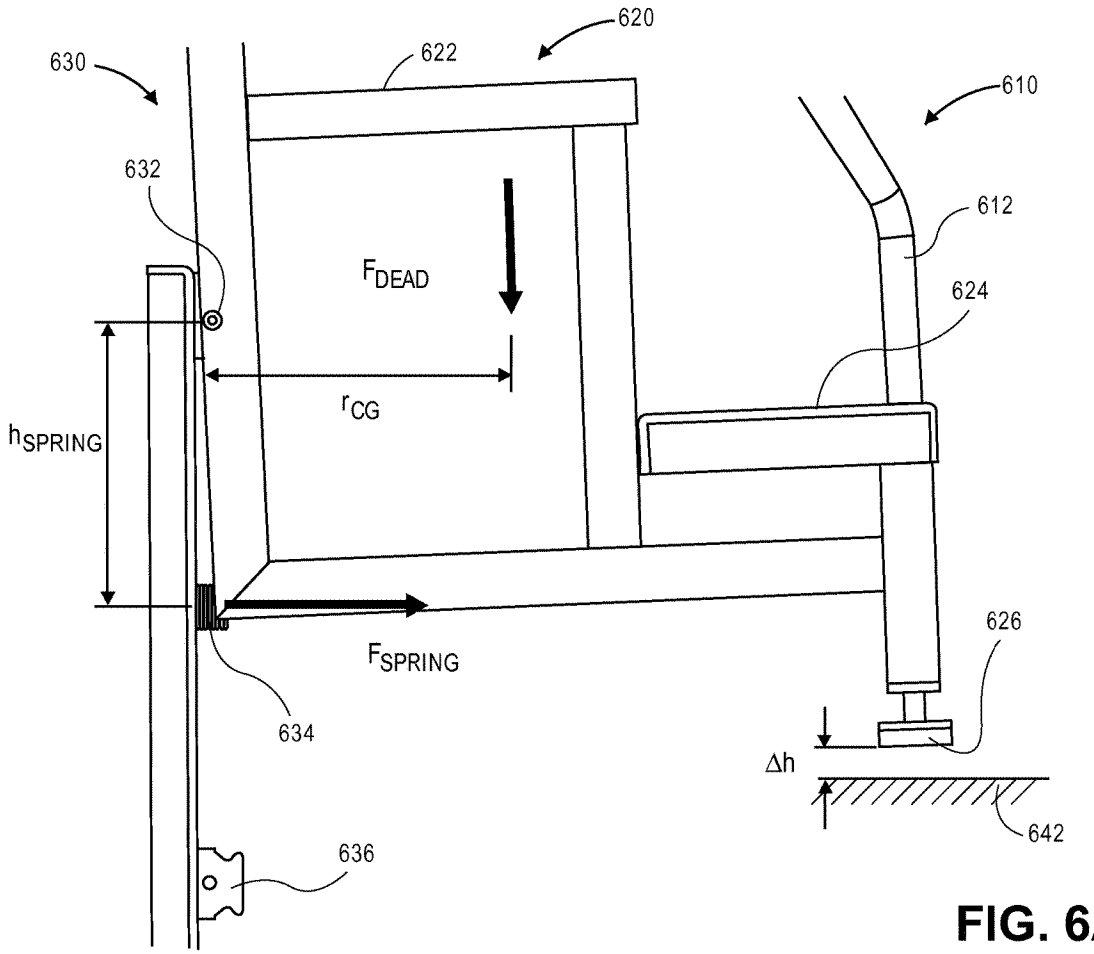
Figure 6B:
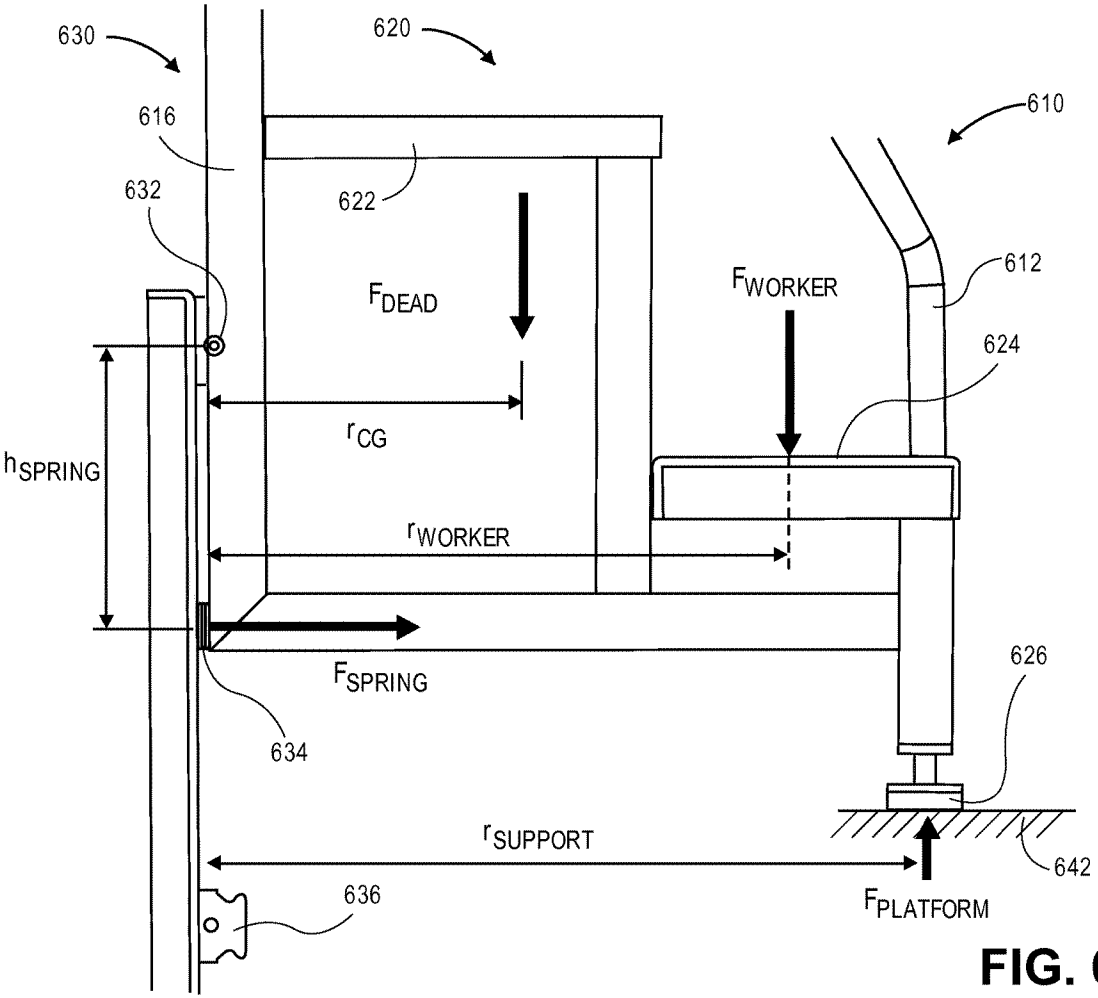

The operation of a sliding ladder unit of the present disclosure having a compression biasing element in loaded and unloaded conditions, e.g., in an open or raised position and in a closed or lowered position, is shown in FIGS. 6A and 6B. Referring to FIGS. 6A and 6B, views of components of one system including a sliding ladder unit 610 in accordance with embodiments of the present disclosure are shown. Except where otherwise noted, reference numerals preceded by the number "6" shown in FIGS. 6A and 6B indicate components or features that are similar to components or features having reference numerals preceded by the number "5" shown in FIGS. 5A and 5B, by the number "4" shown in FIG. 4, by the number "3" shown in FIGS. 3A through 3C, by the number "2" shown in FIGS. 2A through 2C or by the number "1" shown in FIGS. 1A through 1C.

Referring to FIG. 6A, a free body diagram of the sliding ladder unit 610 in an unloaded condition is shown. The sliding ladder unit 610 includes a handrail 612, a stair assembly 620 and a mounting frame 630. The stair assembly 620 includes a first stair or riser 622, a second stair or riser 624 and a contact footing 626. The mounting frame 630 includes a hinge 632, a compression spring 634 and a roller assembly 636 or other rolling implement for mounting the mounting frame to a platform assembly (not shown) having a platform 642.

As is shown in FIG. 6A, the force provided by the dead weight of the stair assembly 620, or $F_{DEAD}$, which is applied at a center of gravity of the stair assembly 620, or at a distance $r_{CG}$ from the hinge 632, creates a first moment about an axis defined by the hinge 632. Conversely, the spring force $F_{SPRING}$ provided by the deflection of the compression spring 634, which is applied at a distance $h_{SPRING}$ from the hinge 632, creates a second moment about the axis defined by the hinge 632. The first moment acts in a direction opposite to the second moment. Therefore, where the first moment equals the second moment, the contact footing 626 is suspended above the platform 642 by a distance Δh. In some embodiments, the distance Δh is preferably not more than one inch (1"). Additionally, in accordance with the present disclosure, one or more attributes of the compression spring 634, such as the spring constant and/or the distance $h_{SPRING}$ between the compression spring 634 and the hinge 632, may be selected in a manner that ensures that the contact footing 626 remains suspended above the platform 642 by the distance Δh when the sliding ladder unit 610 is not loaded with any additional weight beyond the dead weight of the stair assembly 620, or $F_{DEAD}$.

Referring to FIG. 6B, a free body diagram of the sliding ladder unit 610 in a loaded condition is shown. As is shown in FIG. 6B, the force provided by the weight of a worker on the second stair or riser 624, or $F_{WORKER}$, applied at a distance of the second stair or riser 624 from the hinge 632, or $r_{WORKER}$, creates a third moment about the axis defined by the hinge 632. Where the sum of the first moment and the third moment exceeds the second moment created by the deflection of the compression spring 634, the contact footing 626 comes into contact with the platform 642, which provides a force $F_{PLATFORM}$ to the contact footing 626 at a distance $r_{SUPPORT}$ from the hinge 632. The force $F_{PLATFORM}$ creates a fourth moment about the axis defined by the hinge 632, acting in the same direction as the second moment, and in a direction opposite to both the first moment and the third moment. Thus, the sliding ladder unit 610 is stabilized when the sum of the first moment, the second moment, the third moment and the fourth moment is zero, which occurs where the force $F_{PLATFORM}$ provides sufficient support to the sliding ladder unit 610 and the worker in the loaded condition.

Figure 7A:
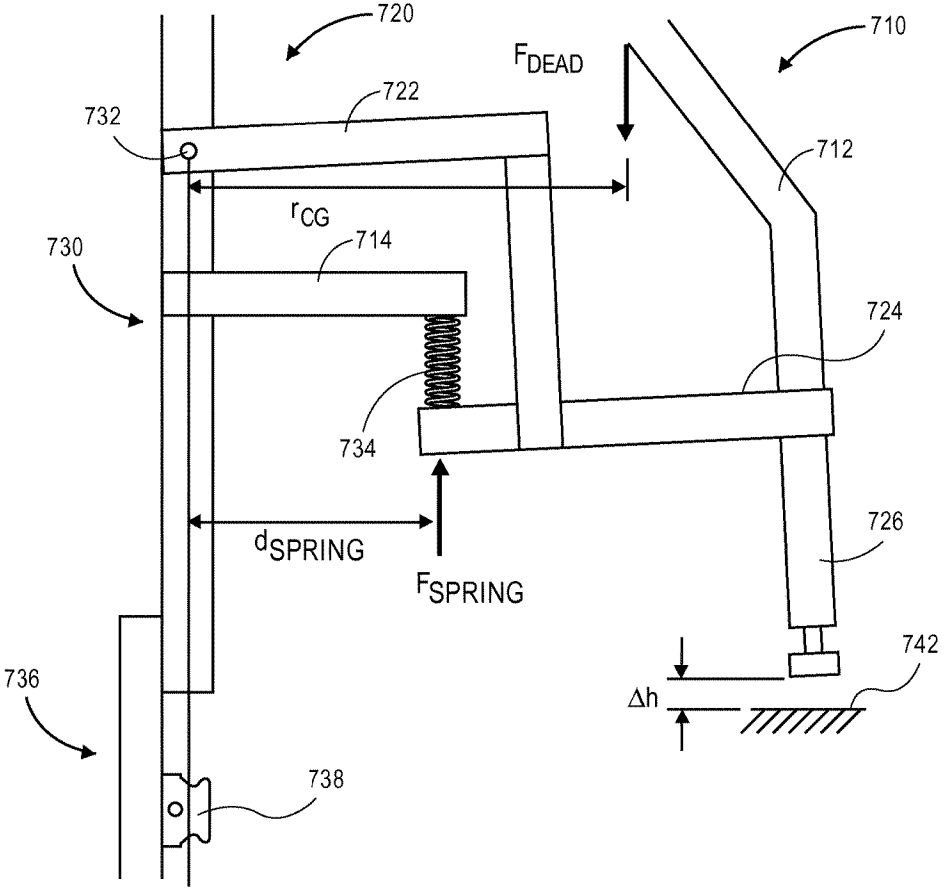
Figure 7B:
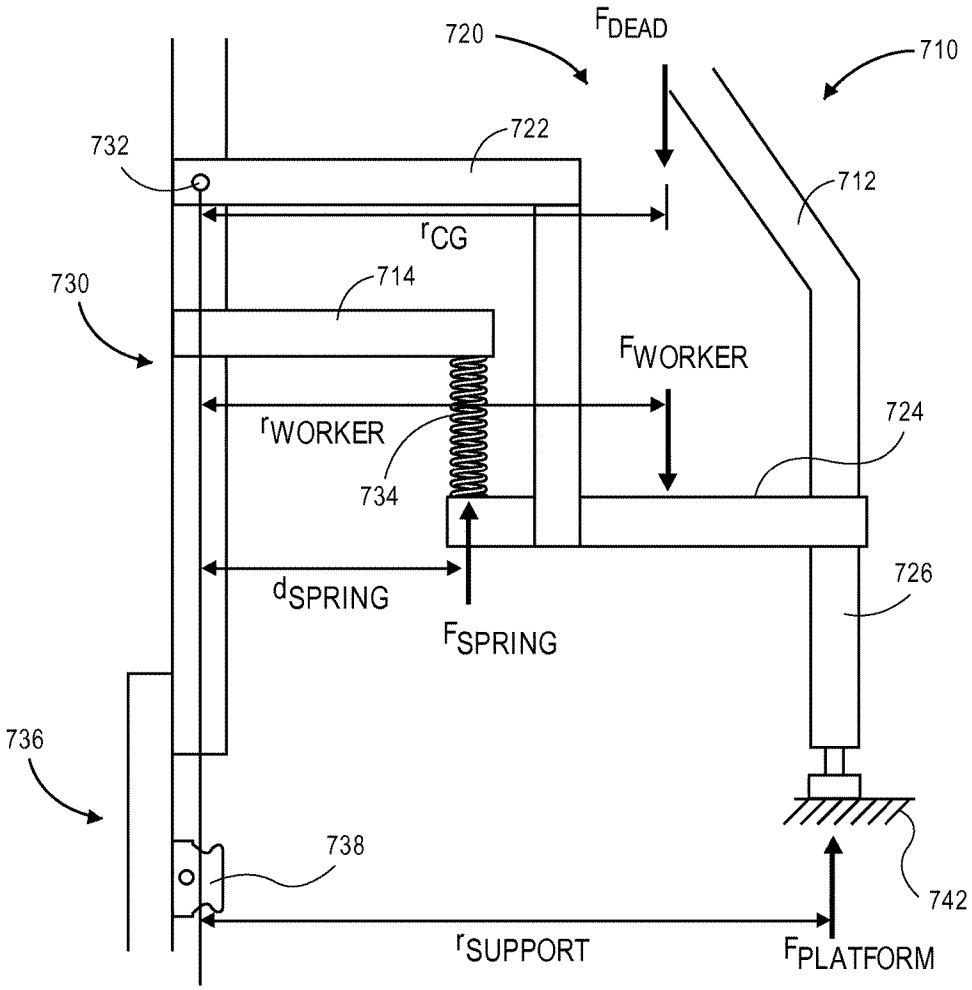

Similarly, the operation of a slider ladder unit of the present disclosure having an extension biasing element in loaded and unloaded conditions, e.g., in an open or raised position and in a closed or lowered position, is shown in FIGS. 7A and 7B. Referring to FIGS. 7A and 7B, views of components of one system including a sliding ladder unit 710 in accordance with embodiments of the present disclosure are shown. Except where otherwise noted, reference numerals preceded by the number "7" shown in FIGS. 7A and 7B indicate components or features that are similar to components or features having reference numerals preceded by the number "6" shown in FIGS. 6A and 6B, by the number "5" shown in FIGS. 5A and 5B, by the number "4" shown in FIG. 4, by the number "3" shown in FIGS. 3A through 3C, by the number "2" shown in FIGS. 2A through 2C or by the number "1" shown in FIGS. 1A through 1C.

Referring to FIG. 7A, a free body diagram of the sliding ladder unit 710 in an unloaded condition is shown. The sliding ladder unit 710 includes a handrail 712, at least one upper frame element 714 joined to the mounting frame 730, a stair assembly 720 and a mounting frame 730. The stair assembly 720 includes a first stair or riser 722, a second stair or riser 724 and a contact footing 726. The mounting frame 730 includes an extension spring 734 and a roller assembly 736 or other rolling implement having at least one roller 738 for mounting the mounting frame to a platform assembly (not shown) having a platform 742.

As is shown in FIG. 7A, the force provided by the dead weight of the stair assembly 720, or $F_{DEAD}$, which is applied at a center of gravity of the stair assembly 720, or at a distance $r_{CG}$ from the hinge 732, creates a first moment about an axis defined by the hinge 732. Conversely, the spring force $F_{SPRING}$ provided by the deflection of the extension spring 734, which is applied at a distance $d_{SPRING}$ from the hinge 732, creates a second moment about the axis defined by the hinge 732. The first moment acts in a direction opposite to the second moment. Therefore, where the first moment equals the second moment, the contact footing 726 is suspended above the platform 742 by a distance Δh.

Referring to FIG. 7B, a free body diagram of the sliding ladder unit 710 in a loaded condition is shown. As is shown in FIG. 7B, the force provided by the weight of a worker on the second stair or riser 724, or $F_{WORKER}$, applied at a distance of the second stair or riser 724 from the hinge 732, or $r_{WORKER}$, creates a third moment about the axis defined by the hinge 732. Where the sum of the first moment and the third moment exceeds the second moment created by the deflection of the extension spring 734, the contact footing 726 comes into contact with the platform 742, which provides a force $F_{PLATFORM}$ to the contact footing 726 at a distance $r_{SUPPORT}$ from the hinge 732. The force $F_{PLATFORM}$ creates a fourth moment about the axis defined by the hinge 732, acting in the same direction as the second moment, and in a direction opposite to both the first moment and the third moment. Thus, the sliding ladder unit 710 is stabilized when the sum of the first moment, the second moment, the third moment and the fourth moment is zero, which occurs where the force $F_{PLATFORM}$ provides sufficient support to the sliding ladder unit 710 and the worker in the loaded condition.

Figure 8:
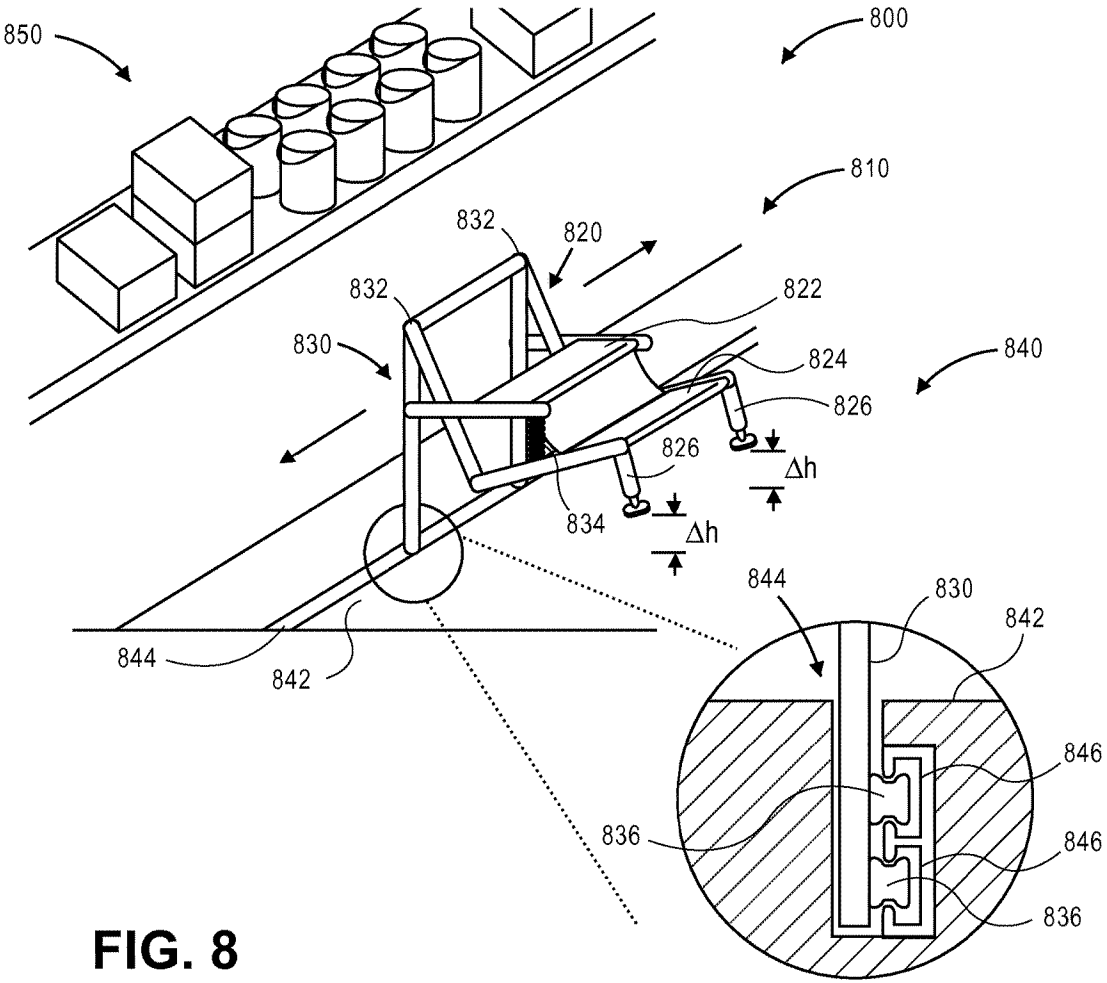
FIG. 8 is a view of components of one system including a sliding ladder unit in accordance with embodiments of the present disclosure, in which the sliding ladder unit is shown mounted to a floor assembly in an unloaded condition.

Those of ordinary skill in the pertinent arts will recognize that the sliding ladder units of the present disclosure may be provided in connection with any working surface, and need not be associated with a platform, a deck or another like raised level. Referring to FIG. 8, a view of components of one system 800 including a sliding ladder unit 810 in accordance with embodiments of the present disclosure is shown. Except where otherwise noted, reference numerals preceded by the number "8" shown in FIG. 8 indicate components or features that are similar to components or features having reference numerals preceded by the number "7" shown in FIGS. 7A and 7B, by the number "6" shown in FIGS. 6A and 6B, by the number "5" shown in FIGS. 5A and 5B, by the number "4" shown in FIG. 4, by the number "3" shown in FIGS. 3A through 3C, by the number "2" shown in FIGS. 2A through 2C or by the number "1" shown in FIGS. 1A through 1C.

As is shown in FIG. 8, the sliding ladder unit 810 includes a stair assembly 820 and a mounting frame 830, and is shown as mounted to a floor assembly 840 in an unloaded condition (e.g., in an open or raised position). The stair assembly 820 includes an upper stair 822, a lower stair 824 and a pair of contact footings 826, and is rotatably mounted to the mounting frame 830 by a hinge 832. The floor assembly 840 includes a floor 842, a channel 844 and a pair of tracks 846 mounted within the channel 844 and embedded beneath the floor 842.

As is shown in FIG. 8, the mounting frame 830 is mounted to the floor assembly 840 by way of a plurality of rollers 836 that are received within the corresponding tracks 846 embedded beneath the floor 842. The stair assembly 820 further includes an extension spring 834 that maintains the lower stair 824 and the contact footings 826 suspended above the floor 842 by a height Δh when the sliding ladder unit 810 is in the unloaded condition. Therefore, the sliding ladder unit 810 may slide along the floor 842 in a low-friction manner, and in a direction and along a path defined by the channel 844, while the sliding ladder unit 810 is in the unloaded condition. When the sliding ladder unit 810 reaches a desired location, the upper stair 822 or the lower stair 824 may be loaded with a mass of one or more workers or objects, and the contact footings 826 of the stair assembly 820 will come into contact with the floor 842.

Figure 9:
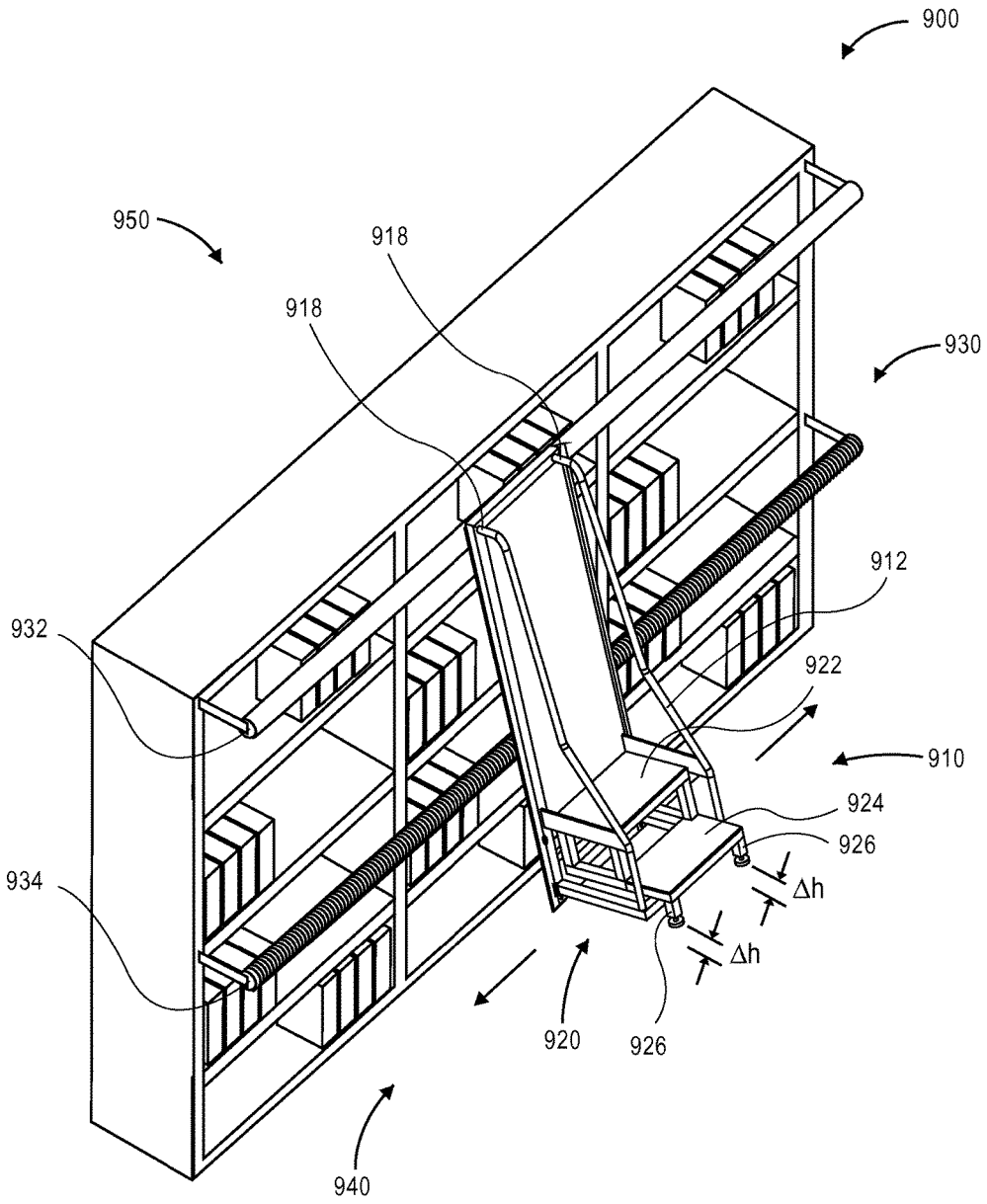
FIG. 9 is a view of components of one system configured for use with a sliding ladder unit in accordance with embodiments of the present disclosure, in which the sliding ladder unit is shown mounted to a bookshelf in an unloaded condition.

As is discussed above, the sliding ladder units of the present disclosure may be provided in any environment in which a ladder is desired for use in multiple locations that are within a vicinity of one another, such as the shelving units of a department store or a library. Referring to FIG. 9, a view of components of one system 900 including a sliding ladder unit 910 in accordance with embodiments of the present disclosure is shown. Except where otherwise noted, reference numerals preceded by the number "9" shown in FIG. 9 indicate components or features that are similar to components or features having reference numerals preceded by the number "8" shown in FIG. 8, by the number "7" shown in FIGS. 7A and 7B, by the number "6" shown in FIGS. 6A and 6B, by the number "5" shown in FIGS. 5A and 5B, by the number "4" shown in FIG. 4, by the number "3" shown in FIGS. 3A through 3C, by the number "2" shown in FIGS. 2A through 2C or by the number "1" shown in FIGS. 1A through 1C.

As is shown in FIG. 9, the system 900 includes the sliding ladder unit 910 and a bookshelf 950 provided in a library, a bookstore or another like environment. The sliding ladder unit 910 further includes a pair of handrails 912, a back plate 918 and a stair assembly 920 including stairs or risers 922, 924 and a pair of supports 926. The sliding ladder unit 910 is joined to the bookshelf 950 by a mounting unit 930 including a hinged bar 932 and a spring-loaded contact bar 934. If the sliding ladder unit 910 is not loaded with the weight of a worker and one or more items (e.g., books), the supports 926 are elevated above a floor surface 940 at a height Δh due to a spring force provided by the spring-loaded contact bar 934. For example, the spring-loaded contact bar 934 may be formed from an elastic material that provides a spring force in response to a deflection due to a loading of the stair assembly 920, such as a bendable bar. Alternatively, the spring-loaded contact bar 934 may be a rigid bar having a hinged connection to the bookshelf 950 with one or more springs (e.g., torsion springs) which resist a rotation of the rigid bar about the hinged connection by generating a spring force in response to such a deflection. The sliding ladder unit 910 may thus travel along the hinged bar 932 of the bookshelf 950 in a linear, low-friction manner to a desired location while supported by the spring-loaded contact bar 934.

When the sliding ladder unit 910 arrives at the desired location, a worker may ascend the sliding ladder unit 910 to perform one or more tasks (e.g., to return books to the bookshelf 950, or to retrieve books from the bookshelf 950), and the sliding ladder unit 910 will rotate downward about an axis defined by the hinged bar 932 against the spring force provided by the spring-loaded contact bar 934, such that the supports 926 come into contact with the floor surface 940. After the worker has completed the performance of the one or more tasks, and steps off the ladder, the spring force provided by the spring-loaded contact bar 934 causes the sliding ladder unit 910 to rotate about the axis defined by the hinged bar 932, and lifts the supports 926 from the floor surface 940, thereby enabling the sliding ladder unit 910 to again travel along the hinged bar 932 of the bookshelf 950 in a linear, low-friction manner to a subsequently desired location with the supports 926 elevated above the floor surface 940.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. For example, although some of the sliding ladder units are shown or described herein for use in a materials handling facility such as a fulfillment center, those of ordinary skill in the pertinent arts will recognize that the systems and methods disclosed herein are not so limited, and may be used to enable access to any number of vertical elevations in any environment and for any purpose.

Moreover, although some of the sliding ladder units described herein include stair or riser assemblies having just two stairs or risers, the present disclosure is not so limited, and the sliding ladder units of the present disclosure may feature any number of stairs or risers, as well as rungs, platforms, handrails or other components ordinarily associated with ladders. Additionally, the sliding ladder units of the present disclosure may include any number of roller assemblies, which may be configured to mate or interface with any number of corresponding tracks or rails of a floor, a platform assembly or other like component.

Furthermore, although some of the sliding ladder units disclosed herein include hinges or hinged connections, or rotatable or pivotable components, having specific types or forms, e.g., bearing blocks or like components such as mounted bearings and pillow blocks, plummer blocks or other bearing housings, those of ordinary skill in the pertinent arts will recognize that references to such hinges, such connections or such components, or structures or functions of such hinges, such connections or such components, herein may be accommodated by any machine elements that permit pure rotations or twists about screws or screw axes having zero pitches, or may be characterized by revolute or prismatic joints, including one or more elements that may couple both translations and rotations. The sliding ladder units disclosed herein are not limited to any specific type or form of hinge or hinged connection, or to any specific type or form of rotatable or pivotable component.

It should be understood that, unless otherwise explicitly or implicitly indicated herein, any of the features, characteristics, alternatives or modifications described regarding a particular embodiment herein may also be applied, used, or incorporated with any other embodiment described herein, and that the drawings and detailed description of the present disclosure are intended to cover all modifications, equivalents and alternatives to the various embodiments as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain embodiments could include, or have the potential to include, but do not mandate or require, certain features, elements and/or steps. In a similar manner, terms such as "include," "including" and "includes" are generally intended to mean "including, but not limited to." Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative embodiments thereof, the foregoing and various other additions and omissions may be made therein and thereto without departing from the spirit and scope of the present disclosure.

What is claimed is:

1. A materials handling system comprising:

a rail extending along a first axis;

a ladder unit comprising:

a mounting frame slidably connected to the rail such that the mounting frame is configured to translate along the first axis, the mounting frame comprising a roller assembly having at least one roller; and a stair assembly rotatably mounted to the mounting frame by at least one hinge that defines a second axis, the stair assembly including at least one support footing, the stair assembly being pivotable in relation to the mounting frame about the second axis between a first position wherein the at least one support footing is at a first height, and a second position wherein the at least one support footing is at a second height that is lower than the first height, the second axis being parallel to the first axis; and at least one spring element including a first end and a second end, the at least one spring element attached to the mounting frame and attached to the stair assembly, wherein the at least one spring element is configured to resist rotation of the stair assembly from the first position to the second position;

wherein the at least one hinge is directly connected to the mounting frame and the stair assembly.

2. The materials handling system of claim 1, wherein the rail is configured to receive the at least one roller.

3. The materials handling system of claim 1, wherein the stair assembly further comprises at least one handrail and at least one backplate, and wherein the at least one backplate is rotatably mounted relative to the mounting frame by the at least one hinge.

4. The materials handling system of claim 1, wherein the first axis is disposed below the second axis.

5. A slidable ladder unit comprising:

a rail extending along a first axis;

a mounting frame slidably connected to the rail such that the mounting frame is configured to translate along the first axis;

a riser assembly comprising at least one riser and at least one contact footing, the riser assembly being pivotable in relation to the mounting frame about a second axis between a first position wherein the at least one contact footing is at a first height, and a second position wherein the at least one contact footing is at a second height that is lower than the first height, the second axis being parallel to the first axis, wherein the riser assembly is rotatably mounted to the mounting frame by at least one hinge, and wherein the at least one hinge is directly connected to the mounting frame and the riser assembly; and at least one biasing element configured to bias the riser assembly to the first position; wherein the at least one biasing element is directly connected to the mounting frame.

6. The slidable ladder unit of claim 5, wherein the at least one biasing element is mounted to at least a portion of the mounting frame at a first distance from the second axis, and wherein a center of gravity of the riser assembly is at a second distance from the second axis, the second distance being different than the first distance.

7. The slidable ladder unit of claim 6, wherein at least one of a spring constant of the at least one biasing element or the first distance is selected based at least in part on at least one of a dead weight of the riser assembly or the second distance.

8. The slidable ladder unit of claim 5, wherein the at least one biasing element is a compression spring having a substantially cylindrical shape, and wherein the compression spring is formed from a polyester-based elastomer.

9. The slidable ladder unit of claim 5, further comprising a platform assembly comprising a working surface.

10. The slidable ladder unit of claim 5, wherein the mounting frame comprises a plurality of rollers or bearings, and wherein the rail is configured to receive at least one of the plurality of rollers or bearings of the mounting frame.

11. The slidable ladder unit of claim 10, wherein the rail comprises a first track and a second track aligned in parallel to one another, wherein the first track is configured to receive at least one of the plurality of rollers or bearings of the mounting frame, and wherein the second track is configured to receive at least one of the plurality of rollers or bearings of the mounting frame.

12. The slidable ladder unit of claim 5, wherein the first axis is disposed below the second axis.

13. A slidable ladder unit comprising:

a rail extending along a first axis;

a mounting frame slidably connected to the rail such that the mounting frame is configured to translate along the first axis;

a riser assembly comprising at least one riser and at least one contact footing, the riser assembly being pivotable in relation to the mounting frame about a second axis between a first position wherein the at least one contact footing is at a first height, and a second position wherein the at least one contact footing is at a second height that is lower than the first height, the second axis being parallel to the first axis, wherein the riser assembly is rotatably mounted to the mounting frame by at least one hinge, and wherein the at least one hinge is directly connected to the mounting frame and the riser assembly;

a roller assembly mounted to the mounting frame, wherein the roller assembly comprises at least one roller configured to roll along the rail; and at least one biasing element configured to rotatably bias the riser assembly toward the first position.

14. The slidable ladder unit of claim 13, wherein the at least one biasing element is a compression spring.

15. The slidable ladder unit of claim 13, wherein the rail is mounted to a first edge of a working surface, or wherein the rail is embedded beneath the working surface.

16. The slidable ladder unit of claim 15, wherein the at least one contact footing does not contact the working surface when the riser assembly is in the first position, and wherein the at least one contact footing contacts the working surface when the riser assembly is in the second position.

17. The slidable ladder unit of claim 13, wherein a height of the at least one riser is selected based at least in part on a height of at least one storage area of at least one mobile drive unit.

18. The slidable ladder unit of claim 13, wherein the first axis is disposed below the second axis.

* * * * *